US007912393B2

(12) United States Patent
Yamada

(10) Patent No.: US 7,912,393 B2
(45) Date of Patent: Mar. 22, 2011

(54) IMAGE-FORMING DEVICE WITH A DENSITY MEASURING UNIT

(75) Inventor: Ryuji Yamada, Ogaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 532 days.

(21) Appl. No.: 12/023,530

(22) Filed: Jan. 31, 2008

(65) Prior Publication Data

US 2008/0181646 A1 Jul. 31, 2008

(30) Foreign Application Priority Data

Jan. 31, 2007 (JP) ..... 2007-020488

(51) Int. Cl.
*G03G 15/00* (2006.01)

(52) U.S. Cl. ..... 399/72

(58) Field of Classification Search ..... 399/72, 399/49

See application file for complete search history.

(56) References Cited

U.S. PATENT DOCUMENTS

| | | | | |
|---|---|---|---|---|
| 7,323,801 | B2 * | 1/2008 | Kojima et al. | 310/268 |
| 7,409,171 | B2 * | 8/2008 | Maeda et al. | 399/50 |
| 2005/0207765 | A1 * | 9/2005 | Ogata | 399/27 |
| 2006/0215212 | A1 | 9/2006 | Tao | |

FOREIGN PATENT DOCUMENTS

| | | | |
|---|---|---|---|
| JP | 6-331630 | | 12/1994 |
| JP | 7-156381 | | 6/1995 |
| JP | 08076531 | A * | 3/1996 |
| JP | 08106217 | A * | 4/1996 |
| JP | 08234635 | A * | 9/1996 |
| JP | 10-324031 | | 12/1998 |
| JP | 11-112822 | | 4/1999 |
| JP | 11174818 | A * | 7/1999 |
| JP | 2006-224465 | | 8/2006 |

OTHER PUBLICATIONS

Computer translation of JP08-076531A, Mar. 22, 1996.*

* cited by examiner

*Primary Examiner* — Quana M Grainger

(74) *Attorney, Agent, or Firm* — Scully, Scott, Murphy & Presser, PC

(57) ABSTRACT

An image-forming device includes an image-forming unit, a test image memory, a test image forming unit, a density measuring unit, an abnormality determining unit, a test image re-forming unit, and a density re-measuring unit. The image-forming unit forms an image on a recording medium based on inputted image data. The test image memory stores image data of test image used for calibrating density of image to be formed by the image-forming unit. The test image forming unit controls the image-forming unit to form the test image by reading image data for test image stored in the test image memory and outputting the image data to the image-forming unit. The density measuring unit measuring the density of the test image that the image-forming unit forms on the recording medium. The abnormality determining unit compares the density of test image measured by the density measuring unit with prescribed values pre-stored in association with the test images to determine whether the measured density is abnormal. The test image re-forming unit controls the image-forming unit to re-form test image determined to be abnormal by the abnormality determining unit on the recording medium by outputting image data for the test image determined to be abnormal to the image-forming unit. The density re-measuring unit measures the density of the test image that the image-forming unit re-forms on the recording medium.

12 Claims, 15 Drawing Sheets

FIG.3

CONTENT OF DENSITY PATCH FORMATION DATA AREA 23b

| DENSITY PATCH NAME | COLOR | SET DENSITY (%) | X COORDINATE POSITION | Y COORDINATE POSITION | WIDTH | HEIGHT |
|---|---|---|---|---|---|---|
| CYAN 1 | CYAN | 100 | X1 | Y1 | a | b |
| MAGENTA 1 | MAGENTA | 100 | X1 | Y2=Y1+b | a | b |
| YELLOW 1 | YELLOW | 100 | X1 | Y3=Y2+b | a | b |
| BLACK 1 | BLACK | 100 | X1 | Y4=Y3+b | a | b |
| CYAN 2 | CYAN | 80 | X1 | Y5=Y4+b | a | b |
| MAGENTA 2 | MAGENTA | 80 | X1 | Y6=Y5+b | a | b |
| YELLOW 2 | YELLOW | 80 | X1 | Y7=Y6+b | a | b |
| BLACK 2 | BLACK | 80 | X1 | Y8=Y7+b | a | b |
| CYAN 3 | CYAN | 60 | X1 | Y9=Y8+b | a | b |
| MAGENTA 3 | MAGENTA | 60 | X1 | Y10=Y9+b | a | b |
| YELLOW 3 | YELLOW | 60 | X1 | Y11=Y10+b | a | b |
| BLACK 3 | BLACK | 60 | X1 | Y12=Y11+b | a | b |
| CYAN 4 | CYAN | 40 | X1 | Y13=Y12+b | a | b |
| MAGENTA 4 | MAGENTA | 40 | X1 | Y14=Y13+b | a | b |
| YELLOW 4 | YELLOW | 40 | X1 | Y15=Y14+b | a | b |
| BLACK 4 | BLACK | 40 | X1 | Y16=Y15+b | a | b |
| CYAN 5 | CYAN | 20 | X1 | Y17=Y16+b | a | b |
| MAGENTA 5 | MAGENTA | 20 | X1 | Y18=Y17+b | a | b |
| YELLOW 5 | YELLOW | 20 | X1 | Y19=Y18+b | a | b |
| BLACK 5 | BLACK | 20 | X1 | Y20=Y19+b | a | b |

FIG.5

CONTENT OF NORMAL VALUE TABLE MEMORY AREA 23c

| | DENSITY PATCH NAME (SET DENSITY (%)) | MINIMUM VALUE OF MEASURED DENSITY | MAXIMUM VALUE OF MEASURED DENSITY |
|---|---|---|---|
| C1 | CYAN 1 (100) | 0.8 | 1.0 |
| M1 | MAGENTA 1 (100) | 0.8 | 1.0 |
| Y1 | YELLOW 1 (100) | 0.8 | 1.0 |
| K1 | BLACK 1 (100) | 0.8 | 1.0 |
| C2 | CYAN 2 (80) | 0.6 | 0.9 |
| M2 | MAGENTA 2 (80) | 0.6 | 0.9 |
| Y2 | YELLOW 2 (80) | 0.6 | 0.9 |
| K2 | BLACK 2 (80) | 0.6 | 0.9 |
| C3 | CYAN 3 (60) | 0.4 | 0.7 |
| M3 | MAGENTA 3 (60) | 0.4 | 0.7 |
| Y3 | YELLOW 3 (60) | 0.4 | 0.7 |
| K3 | BLACK 3 (60) | 0.4 | 0.7 |
| C4 | CYAN 4 (40) | 0.2 | 0.5 |
| M4 | MAGENTA 4 (40) | 0.2 | 0.5 |
| Y4 | YELLOW 4 (40) | 0.2 | 0.5 |
| K4 | BLACK 4 (40) | 0.2 | 0.5 |
| C5 | CYAN 5 (20) | 0.1 | 0.3 |
| M5 | MAGENTA 5 (20) | 0.1 | 0.3 |
| Y5 | YELLOW 5 (20) | 0.1 | 0.3 |
| K5 | BLACK 5 (20) | 0.1 | 0.3 |

CONTENT OF CYAN MEASURED DENSITY MEMORY AREA 24c1

CONTENT OF CYAN TARGET DATA MEMORY AREA 23d1

| | | CYAN TARGET DATA | CYAN MEASURED DENSITY DATA |
|---|---|---|---|
| | DENSITY PATCH NAME (SET DENSITY (%)) | CYAN TARGET DENSITY | DENSITY MEASURED BY DENSITY SENSOR |
| C1 | CYAN 1 (20) | 0.20 | 0.15 |
| C2 | CYAN 2 (40) | 0.40 | 0.25 |
| C3 | CYAN 3 (60) | 0.60 | 0.40 |
| C4 | CYAN 4 (80) | 0.80 | 0.62 |
| C5 | CYAN 5 (100) | 1.00 | 1.00 |

CONTENT OF CYAN CALIBRATION MEMORY AREA 25a1

| SET DENSITY (%) | CALIBRATED SET DENSITY (%) |
|---|---|
| 0 | 0 |
| 20 | 30 |
| 40 | 60 |
| 60 | 75 |
| 80 | 90 |
| 100 | 100 |

(PROCESS EXECUTED BY THE CPU 22)

IMAGE-FORMING DEVICE WITH A DENSITY MEASURING UNIT

CROSS REFERENCE TO RELATED APPLICATION

This application claims priority from Japanese Patent Application No. 2007-020488 filed Jan. 31, 2007. The entire content of its priority application is incorporated herein by reference.

TECHNICAL FIELD

The present invention relates to an image-forming device and a method for measuring density of a test image.

BACKGROUND

Methods of determining the accuracy of density-calibrated images are well known in the art as means for preventing error in density measurements due to changes in properties over time or lot variations. One such method disclosed in Japanese unexamined patent application publication No. HEI-6-331630 involves performing density measurements on samples having known densities and correcting changes over time of image densities based on the results of these measurements.

In this conventional method, after first setting the samples used for calibrating image density, the densities of all samples are measured. If the measured density is determined to be within a preset range, then it is determined whether results of density measurements corresponding to all samples fall within a preset range. If the results of density measurements are found to fall within the preset range for all samples, the calibration results are determined to be normal and density calibration is performed based on these results. However, if the density measurement results for any sample are found to fall outside the preset range for that sample, then the calibration results are determined to be abnormal.

Accordingly, when repeating image density calibration, density measurements must be obtained not only for samples yielding abnormal results, but also for samples yielding normal results. Consequently, samples are unnecessarily consumed by repeating calibration for samples yielding normal results.

SUMMARY

In view of the foregoing, it is an object of the present invention to provide an image-forming device and a method capable of reducing the consumption of image-forming material when repeating image density calibration.

In order to attain the above and other objects, the invention provides an image-forming device including an image-forming unit, a test image memory, a test image forming unit, a density measuring unit, an abnormality determining unit, a test image re-forming unit, and a density re-measuring unit. The image-forming unit forms an image on a recording medium based on inputted image data. The test image memory stores image data of test image used for calibrating density of image to be formed by the image-forming unit. The test image forming unit controls the image-forming unit to form the test image by reading image data for test image stored in the test image memory and outputting the image data to the image-forming unit. The density measuring unit measuring the density of the test image that the image-forming unit forms on the recording medium. The abnormality determining unit compares the density of test image measured by the density measuring unit with prescribed values pre-stored in association with the test images to determine whether the measured density is abnormal. The test image re-forming unit controls the image-forming unit to re-form test image determined to be abnormal by the abnormality determining unit on the recording medium by outputting image data for the test image determined to be abnormal to the image-forming unit. The density re-measuring unit measures the density of the test image that the image-forming unit re-forms on the recording medium.

According to another aspect, the present invention provides a method for measuring density of a test image, including forming a test image based on an test image data; measuring a density of the test image; determining whether the measured density is abnormal with comparing the measured density of test image with prescribed values pre-stored in association with the test images; re-forming test image determined to be abnormal based on the test image data; and re-measuring a density of the test image re-formed.

BRIEF DESCRIPTION OF THE DRAWINGS

The particular features and advantages of the invention as well as other objects will become apparent from the following description taken in connection with the accompanying drawings, in which:

FIG. 3 is a table showing the content of a density patch formation data memory area or an error density patch formation data memory area;

FIG. 5 is a table showing the content of a normal value table memory area;

FIG. 6(*b*) is a graph plotting cyan target density data stored in the cyan target data memory area, and cyan measured density data stored in the cyan measured density memory area;

FIG. 6(*c*) is a table showing the content of a cyan calibration table memory area;

FIG. 12(*b*) is an explanatory diagram conceptually illustrating an example in which the formation position of a density patch will exceed a value Xmax if shifted the patch width.

DETAILED DESCRIPTION

Figure 1:
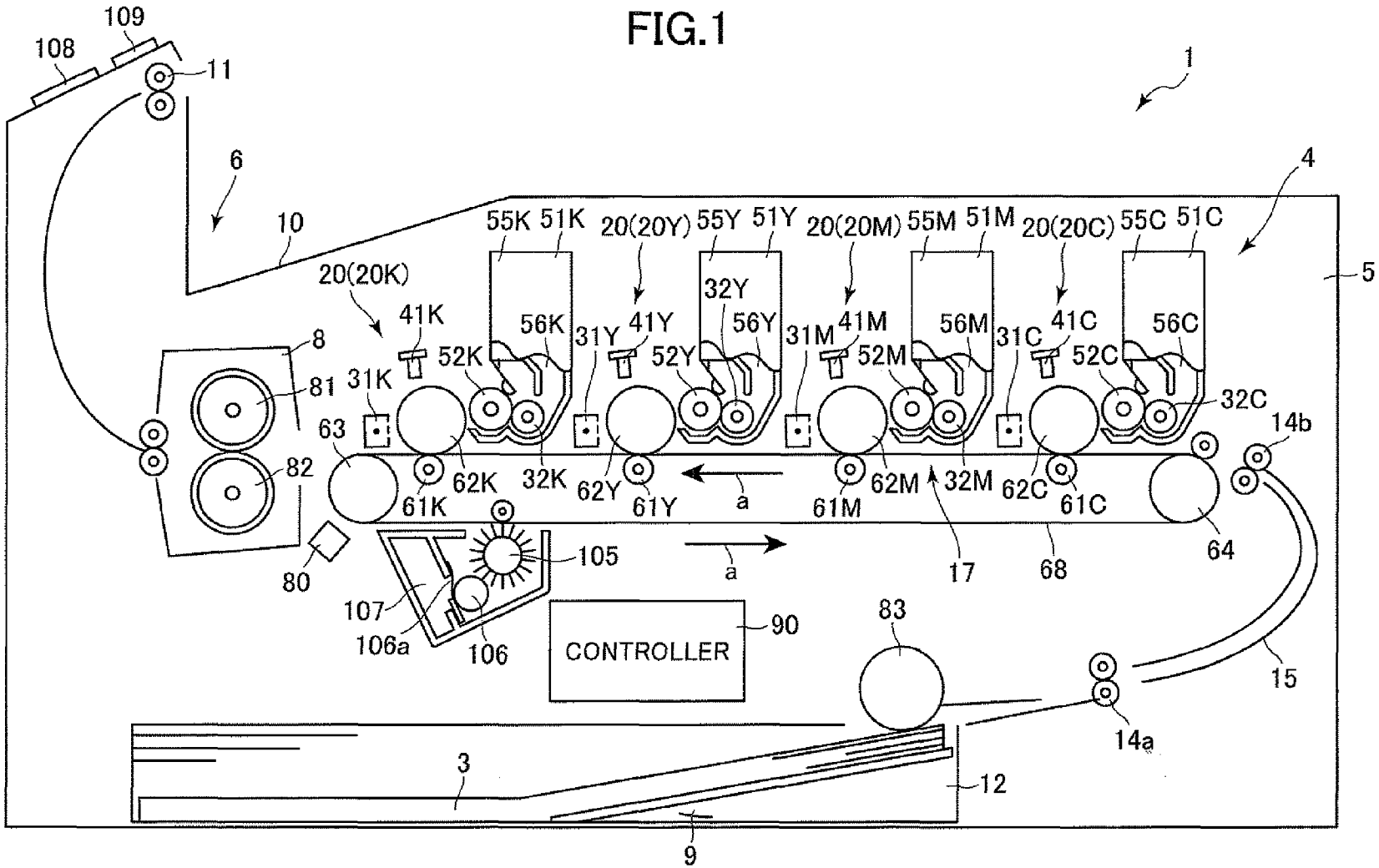
FIG. 1 is a vertical cross-sectional view of a color laser printer according to an embodiment.

FIG. 1 is a vertical sectional view showing an overall configuration of a color laser printer 1 as a first embodiment of the present invention. As shown in FIG. 1, the color laser printer 1 is of a transverse-mounting tandem type in which four image forming units 20 are provided in series in a horizontal direction. The laser printer 1 includes a paper feed section 9, an image forming section 4, a paper ejection section 6 and a control section 90. The paper feed section 9 feeds sheets of recording paper 3 one sheet at a time as recording medium to the image forming section 4. The image forming section 4 forms an image on the fed recording paper 3. The paper ejection section 6 ejects the recording paper 3 on which the image has been formed. The controller 90 controls the color laser printer 1.

The paper feed section 9 includes a paper feed tray 12, a paper feed roller 83 and conveying rollers 14*a* and 14*b*. The paper feed tray 12 is detachably mounted on the main casing 5 from the front side (right side in FIG. 1) in the bottom of the main casing 5. The paper feed roller 83 is provided at one end (at the front side) of the paper feed tray 12. The conveying rollers 14*a* and 14*b* are provided on the downstream side in the conveying direction of the recording paper 3 with respect to the paper feed roller 83 at the front side of the paper feed roller 83.

A plurality of sheets of the recording paper 3 is stacked in the paper feed tray 12. The uppermost sheet of the recording paper 3 is fed towards the conveying rollers 14*a* and 14*b* by rotations of the paper feed roller 83 and is conveyed sequentially between a conveying belt 68 and each of photosensitive drums 62 (62C, 62M, 62Y, and 62K).

In the middle portion of the main casing 5, the image forming section 4 includes four image forming units 20 (20Y, 20M, 20C, and 20K) for forming images, a transfer section 17, and a fixing section 8. The transfer section 17 transfers images formed by each of the image forming units 20 to the recording paper 3. The fixing section 8 fixes the images transferred to the recording paper 3 by heating and pressurizing the same. The above-described subscripts Y, M, C, and K represent the colors of Yellow (Y), Magenta (M), Cyan (C), and Black (K), respectively.

Four image forming units 20 have the same configuration except for storing different colors of toners. Each image forming unit 20 (20C, 20M, 20Y, or 20K) has a photosensitive drum 62 (62C, 62M, 62Y, or 62K), a charger 31 (31C, 31M, 31Y, or 31K), an exposure unit 41 (41C, 41M, 41Y, or 41K), and a developing unit 51 (51C, 51M, 51Y, or 51K). Each charger 31 (31C, 31M, 31Y, or 31K) is provided adjacent to the corresponding photosensitive drum 62 (62C, 62M, 62Y, or 62K) for charging the same. Each exposure unit 41 (41C, 41M, 41Y or 41K) forms an electrostatic latent image on the corresponding photosensitive drum 62 (62C, 62M, 62Y or 62K). The developing unit 51 (51Y, 51M, 51C, or 51K) forms a toner image by providing toner as a developing agent to the photosensitive drum 62 (62C, 62M, 62Y, or 62K), using a development bias applied between the photosensitive drum 62 (62C, 62M, 62Y, or 62K) and the developing unit 51 (51Y, 51M, 51C, or 51K).

Each charger 31 (31C, 31M, 31Y or 31K) is, for example, a Scorotron charger generating corona discharge from a discharging wire made of tungsten and evenly charging the surface of the photosensitive drum 62 (62C, 62M, 62Y or 62K) in a positive polarity. Each exposure unit 41 (41C, 41M, 41Y or 41K) includes an LED array emitting light for forming an electrostatic latent image on the surface of the photosensitive drum 62 (62C, 62M, 62Y or 62K). In this exposure unit 41 (41C, 41M, 41Y or 41K), light emitted from the LED array is irradiated on the photosensitive drum 62 (62C, 62M, 62Y or 62K), and an electrostatic latent image is formed on the surface of the photosensitive drum 62 (62C, 62M, 62Y or 62K). The exposure unit 41 (41C, 41M, 41Y or 41K) need not be an LED array, but may be an exposure unit that emits laser light.

Each developing unit 51 (51C, 51M, 51Y or 51K) has a developing casing 55 (55C, 55M, 55Y or 55K), in which provided are a hopper 56 (56C, 56M, 56Y or 56K), a supply roller 32 (32C, 32M, 32Y or 32K), and a developing roller 52 (52C, 52M, 52Y or 52K). Each hopper 56 (56C, 56M, 56Y or 56K) is formed as an inner space of the developing casing 55 (55C, 55M, 55Y or 55K). Toner of Cyan is contained in the hopper 56C in the image forming unit 20C. Toner of Magenta is contained in the hopper 56M of the image forming unit 20M. Toner of Yellow is contained in the hopper 56Y of the image forming unit 20Y. Toner of Black is contained in the hopper 56K of the image forming unit 20K.

Each supply roller 32 (32C, 32M, 32Y or 32K) is provided in the lower section of the hopper 56 (56C, 56M, 56Y or 56K). A roller portion made of a conductive sponge member is covered on a metallic roller shaft of the supply roller 32 (32C, 32M, 32Y or 32K). Each supply roller 32 (32C, 32M, 32Y or 32K) is rotatably supported so as to rotate in a direction to move opposite to the developing roller 52 (52C, 52M, 52Y or 52K) at a nip portion in contact with the developing roller 52 (52C, 52M, 52Y or 52K).

Each developing roller 52 (52C, 52M, 52Y or 52K) is rotatably provided at a position in contact with the supply roller 32 (32C, 32M, 32Y or 32K). A roller portion made of an elastic member such as a conductive rubber material is covered on a metallic roller shaft of the developing roller 52 (52C, 52M, 52Y or 52K). A developing bias voltage is applied from a power source (not shown) to the developing rollers 52C, 52M, 52Y and 52K.

The transfer section 17 is provided so as to be opposed to the photosensitive drums 62 (62C, 62M, 62Y or 62K) in the main casing 5 and has a conveying belt driving roller 63, a conveying belt follow roller 64, the conveying belt 68 which is an endless belt, and transfer rollers 61 (61C, 61M, 61Y or 61K).

The conveying belt driving roller 63 is provided on the downstream side of the photosensitive drums 62 (62C, 62M, 62Y and 62K) in the conveying direction of the recording paper 3 as well as on the upstream side of the fixing section 8. The conveying belt follow roller 64 is provided on the upstream side of the photosensitive drums 62 (62C, 62M, 62Y and 62K) with respect to the conveying direction of the recording paper 3 as well as at the upper front side of the paper feed roller 83. The conveying belt 68 is wound around between the conveying belt driving roller 63 and the conveying belt follow roller 64, with the outer surface thereof being in contact with all the photosensitive drums 62 of the image forming units 20. The conveying belt 68 is circularly moved in a counter-clockwise direction between the conveying belt driving roller 63 and the conveying belt follow roller 64 by being driven by the conveying belt driving roller 63.

Each transfer roller 61 (61C, 61M, 61Y or 61K) is provided inside the loop of the conveying belt 68 so as to be opposed to the corresponding photosensitive drum 62 (62C, 62M, 62Y or 62K) with interposing the conveying belt 68 therebetween. In a transfer operation, a predetermined voltage is applied between the transfer roller 61 (61C, 61M, 61Y or 61K) and the photosensitive drum 62 (62C, 62M, 62Y or 62K) to transfer toner images from the photosensitive drum 62 (62C, 62M, 62Y or 62K) to the recording paper 3.

The fixing section 8 is provided on the downstream side of the image forming units 20 and the transfer section 17, and has a heating roller 81 and a pressure roller 82. The heating roller 81 is made of a metallic pipe, on the surface of which a release layer is formed. A halogen lamp (not shown) is provided in the heating roller 81 along the axial direction thereof, and the surface of the heating roller 81 is heated to a fixing temperature by the halogen lamp. The pressure roller 82 is provided so as to pressurize the heating roller 81. Toner image on the recording paper 3 is fixed by heat, when conveying the recording paper 3 between the pressure roller 82 and heating roller 81.

The paper discharging section 6 is provided on the downstream side of the fixing section 8 in the upper portion of the main casing 5, and includes a pair of paper discharging rollers 11 and a paper discharging tray 10. The pair of paper discharging rollers 11 discharges the recording paper 3 on which an image has been fixed to the paper discharging tray 10. The paper discharging tray 10 is provided on the downstream side of the paper discharging rollers 11 for accumulating the sheets of the recording paper 3 having completed the image forming process.

A density sensor 80 is provided obliquely rearward below the conveying belt driving roller 63 so as to oppose the outer surface of the conveying belt 68. The density sensor 80 is configured to detect patches formed on the conveying belt 68.

A toner-collecting device 107 is provided obliquely forward below the conveying belt driving roller 63. A cleaning blush 105 is provided in the toner-collecting device 107, and is in contact with the outer surface of the conveying belt 68. The cleaning blush 105 is for electrically scraping off toner (patches and the like described above) adhered to the conveying belt 68. A toner-collecting roller 106 is further provided in the toner-collecting device 107 and is for collecting the toner scraped off by the cleaning blush 105. A blade 106*a* is further provided in the toner-collecting device 107 and scrapes off toner collected by the toner-collecting roller 106. The toner scraped off by the blade 106 is collected in the toner-collecting device 107.

Operation keys 108 and a display device 109 are provided on the main casing 5 at a location above the discharging rollers 11. The operation keys 108 enable a user to input a predetermined command to the color laser printer 1. The display device 109 displays a processing state of the color laser printer 1 and a message for a user.

Figure 2:
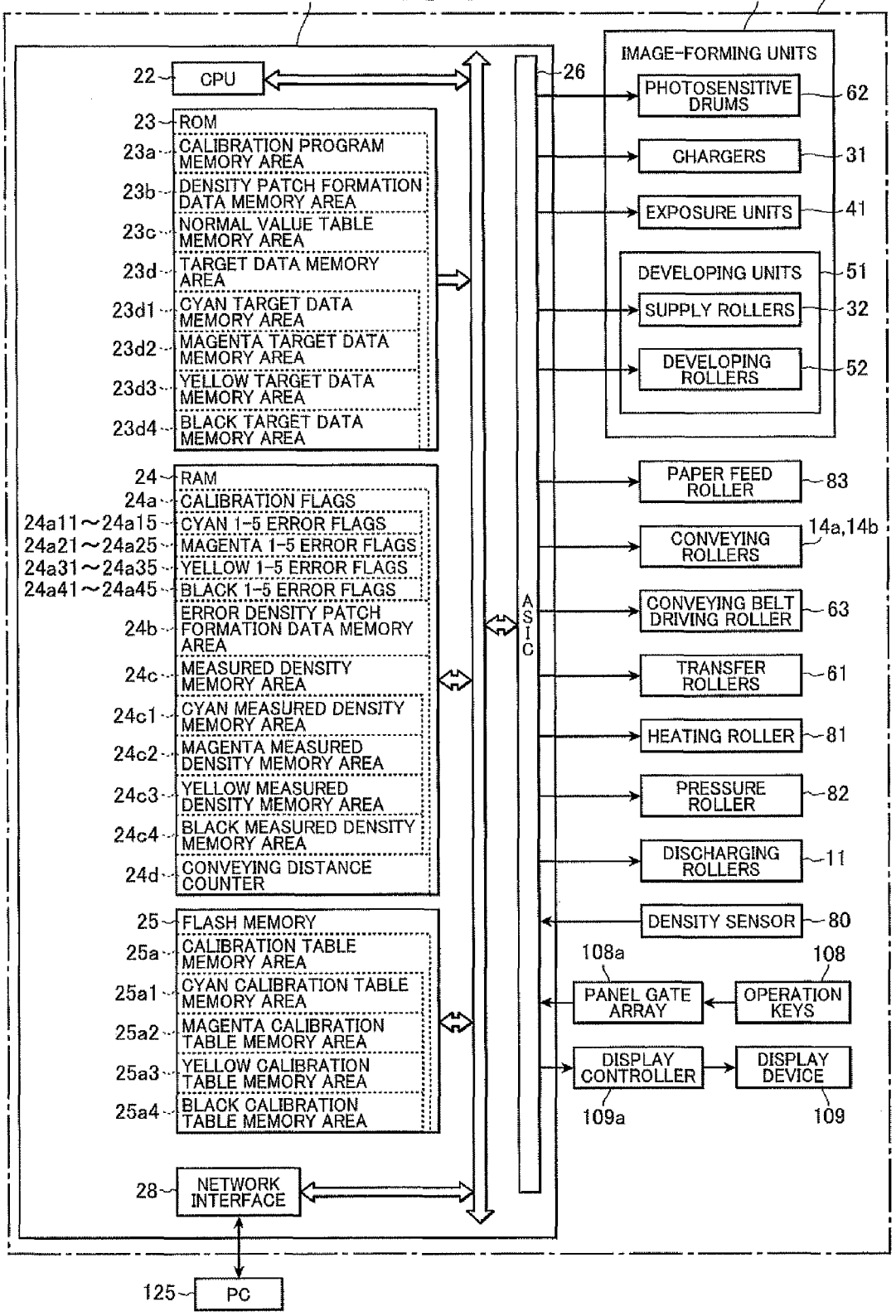
FIG. 2 is a block diagram showing the electrical structure of the color laser printer.

An electric configuration of the color laser printer 1 will be described with reference to FIG. 2. As shown in FIG. 2, the color laser printer 1 is provided with the controller 90 for controlling each component of the apparatus. An ASIC 26 which is part of the controller 90 is connected to the image forming units 20, the paper supply roller 83, the conveying rollers 14*a* and 14*b*, the conveying belt driving roller 63, the transfer rollers 61, the heating roller 81, the pressure roller 82, the paper discharging rollers 11, the density sensor 80, a panel gate array 108*a*, and a display controller 109*a*.

The controller 90 includes a CPU 22, a ROM 23, a RAM 24, a flash memory 25, the ASIC 26, and a network interface 28. The CPU 22, the ROM 23, the RAM 24, the flash memory 25, and the network interface 28 are connected to the ASIC 26 via a bus line. The CPU 22 is a microprocessor for executing various programs stored in the ROM 23. The ROM 23 is a read-only memory for storing programs executed by the CPU 22 and for storing constants and tables that the CPU 22 refers to when executing the programs.

The RAM 24 has a work area in which the CPU 22 temporarily stores variables and the like when executing programs. The flash memory 25 is a rewritable memory device storing various data that can be overwritten when the power is on and is capable of preserving the memory content when the power is off. The ROM 23, RAM 24 and flash memory 25 will be described later.

The ASIC 26 is an integrated circuit that converts commands from the CPU 22 and outputs corresponding signals for driving components of the laser printer 1, and that converts signals outputted from the density sensor 80 and panel gate array 108*a* and outputs the converted signals to the CPU 22.

Each of the photosensitive drums 62 (62C, 62M, 62Y, or 62K), developing rollers 52, feed roller 83, conveying rollers 14*a* and 14*b*, conveying belt driving roller 63, heating roller 81, pressure roller 82, and ejection rollers 11 is connected to the ASIC 26, and includes a motor (not shown) for applying a rotational force and thereto a power source (not shown) for supplying power to the corresponding motor. The ASIC 26 outputs a control signal to rotate each motor, and the rotational force of the motor drives the corresponding element to rotate.

Each of chargers 31 is connected to the ASIC 26 and charges the corresponding photosensitive drum 62 upon receiving a control signal from the ASIC 26.

Each of exposure units 41 is connected to the ASIC 26. The ASIC 26 outputs control signals to each exposure unit 41 to control irradiation of the light beam from the corresponding LED array and to control the irradiated position of the light beam.

The heating roller 81 heats the transmitted toner on the recording paper 3 based on a control signal outputted by the ASIC 26.

The density sensor 80 outputs data of measured densities (described later) to the ASIC 26, and the ASIC 26 stores data of the measured densities in the RAM 24.

The panel gate array 108*a* is connected to the operation keys 108 and controls the operation keys 108. Specifically, the panel gate array 108*a* detects when some operation key 108 is pressed (input) and outputs a prescribed code signal to the ASIC 26. A plurality of code signals is assigned to the plurality of operation keys 108. Upon receiving a prescribed code signal from the panel gate array 108*a*, the ASIC 26 issues an interrupt to the CPU 22. When an interrupt is issued, the CPU 22 performs a prescribed control process based on a key process table. The key process table includes control processes associated with code signals and is stored in the ROM 23, for example.

The display controller 109*a* controls the display of data related to operations of the laser printer 1 and the like on the display unit 109. The display controller 109*a* is connected to and the display unit 109.

The network interface 28 is an interface communicating by means of USB standard and is connected to the PC 125. The network interface 28 can convert image information input from the PC 125 and output the converted image information to the CPU 22.

A PC 125 inputs image information or set densities to the laser printer 1. The PC 125 is connected to and capable of communicating with the network interface 28. The densities of an image formed on the recording paper 3 are determined based on the set densities inputted from the PC 125.

Figures 6A, 6B:
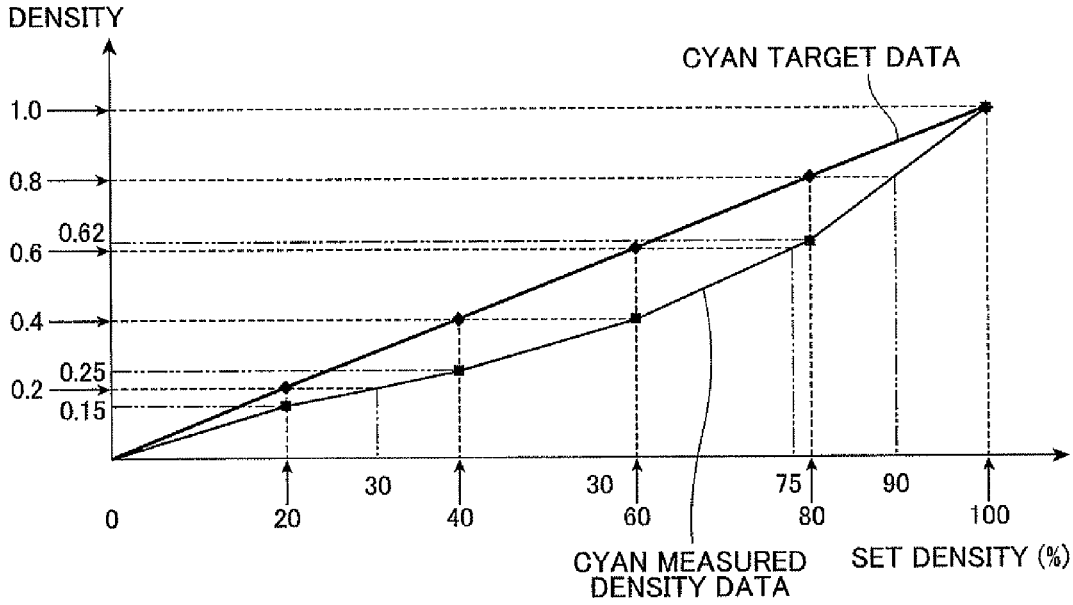
FIG. 6(*a*) is a table showing the content of a cyan target data memory area and a cyan measured density memory area.

Next, the content of the ROM 23 will be described with reference to FIGS. 5 and 6(*a*). As shown in FIG. 2, the ROM 23 includes a calibration program memory 23*a*, a density patch formation data memory area 23*b*, a normal value table memory area 23*c*, and a target memory area 23*d*.

Figure 8:
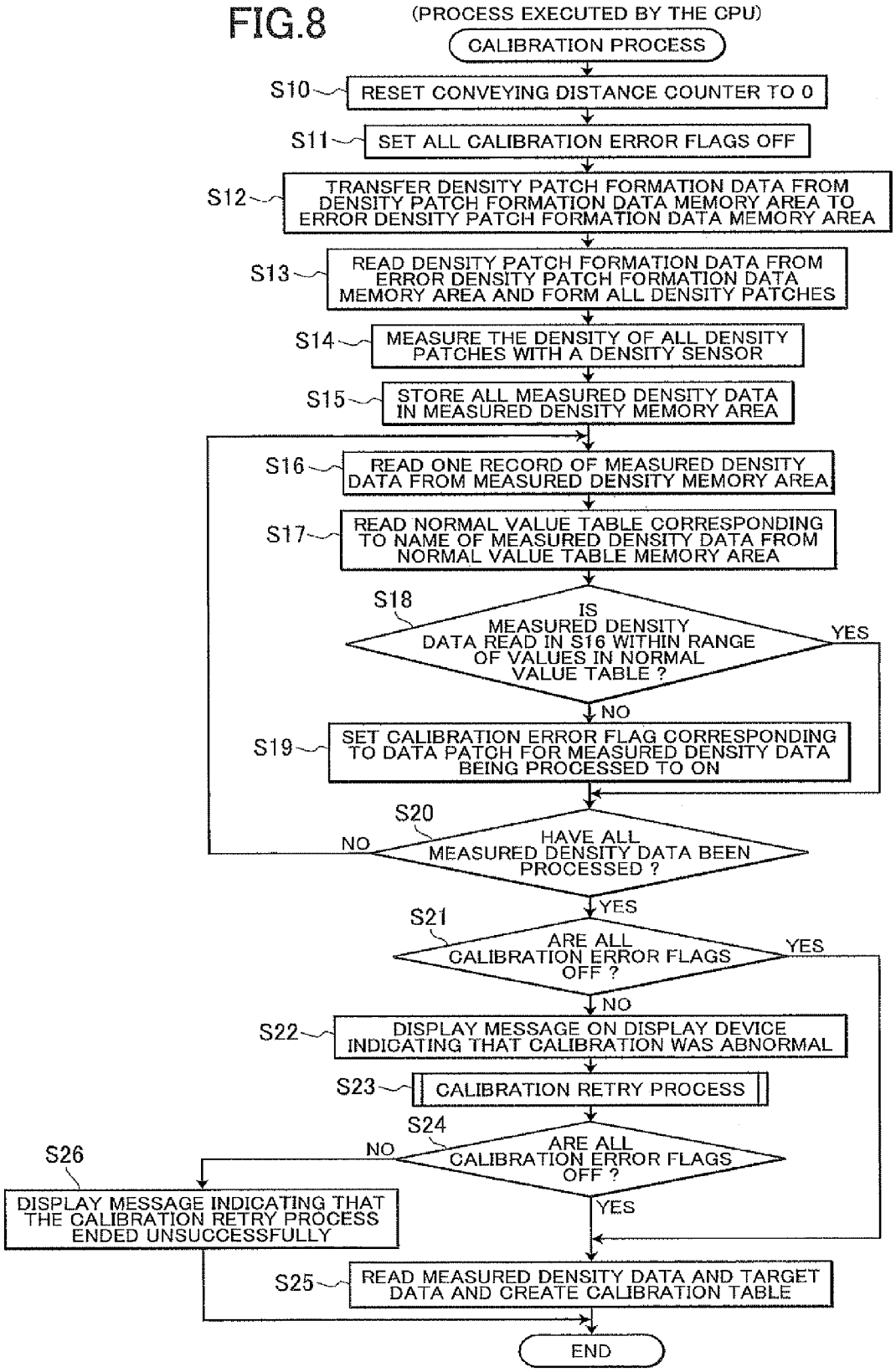
FIG. 8 is a flowchart illustrating steps in a calibration process executed by the CPU.
Figure 9:
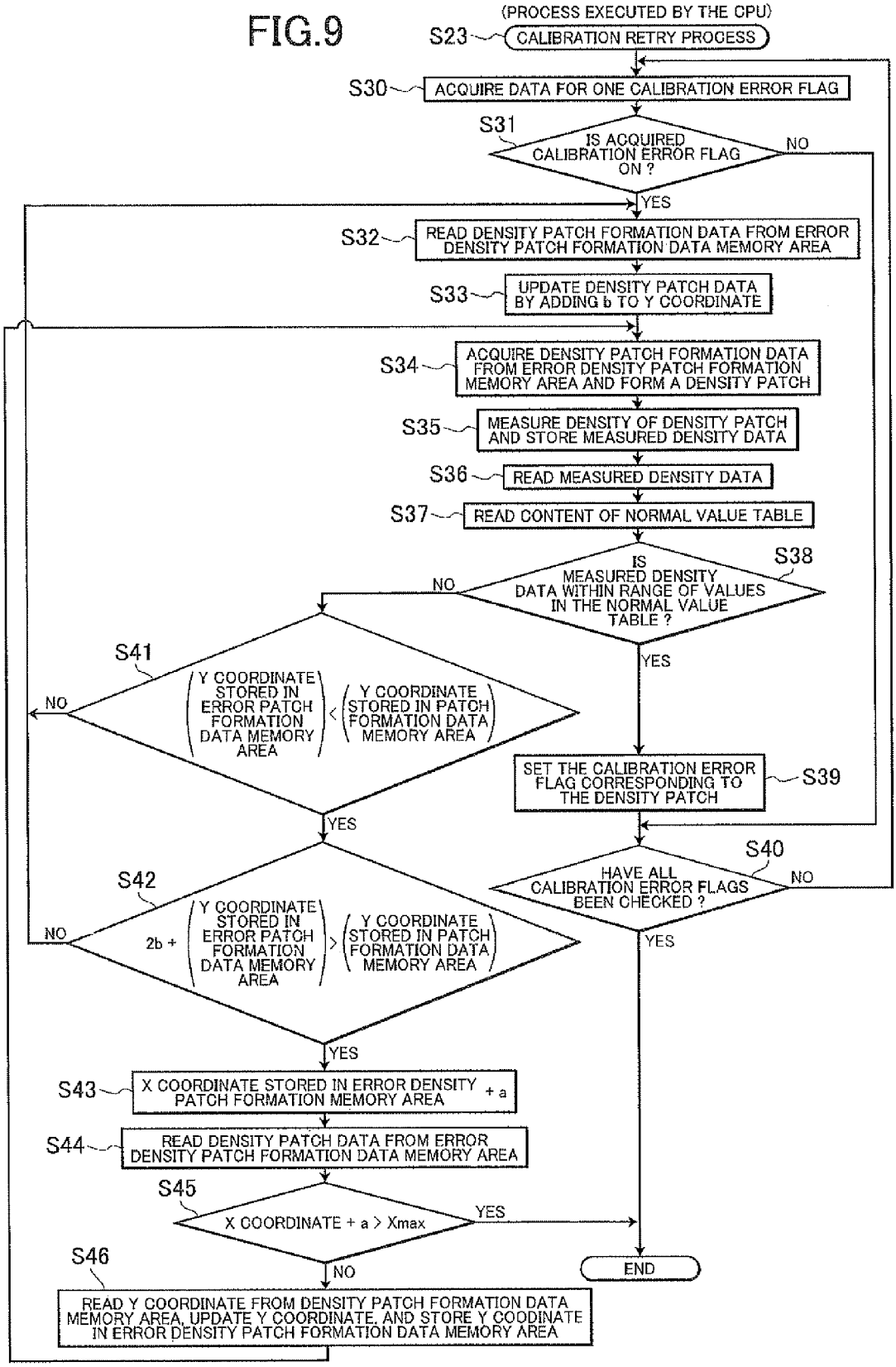
FIG. 9 is a flowchart illustrating steps in a calibration retry process executed by the CPU.

The calibration program memory area 23*a* stores a calibration program, which is a control program executed by the CPU 22 to implement the process described in the flowcharts of FIGS. 8 and 9.

Figure 4:
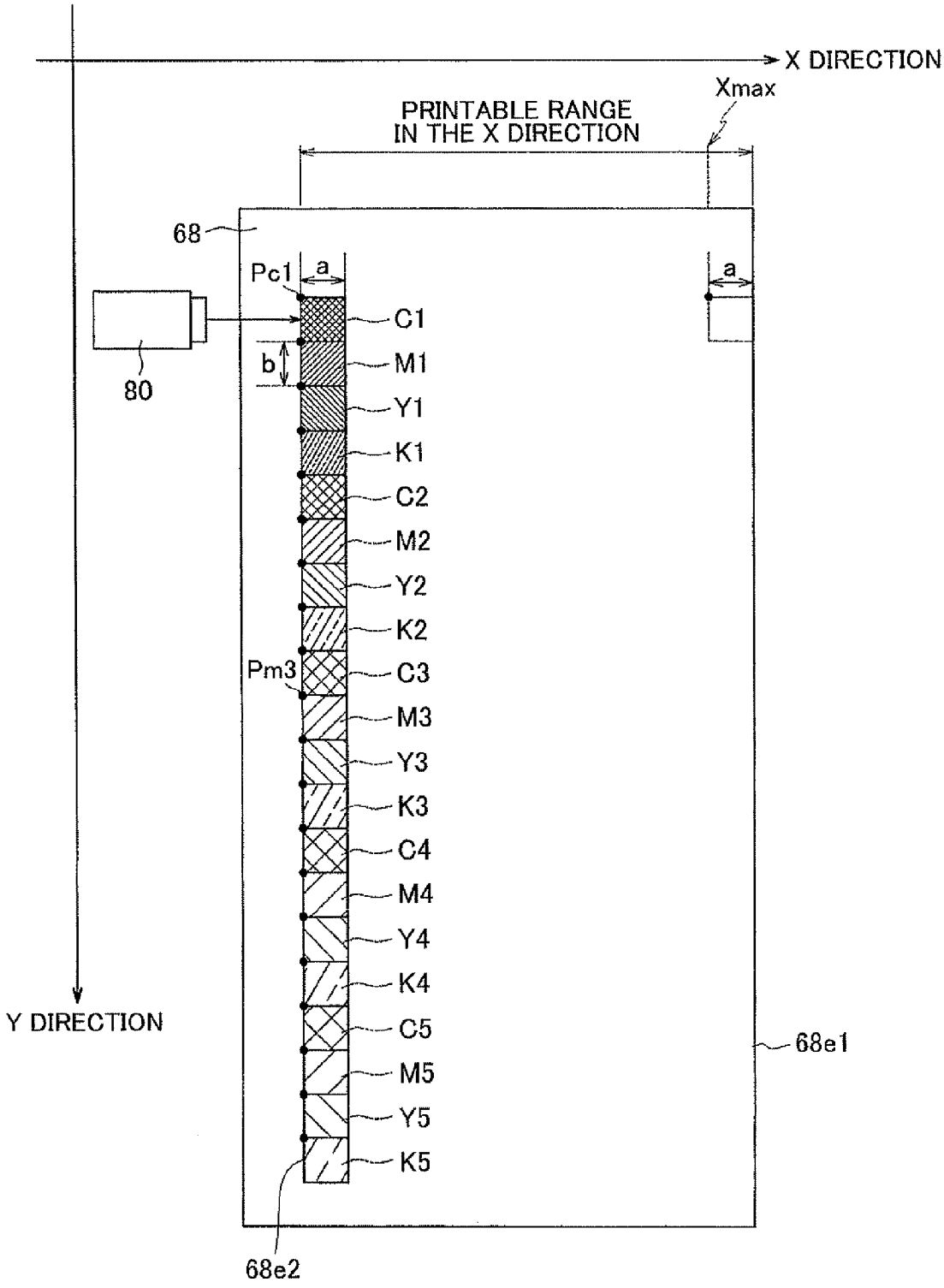
FIG. 4 is an explanatory diagram conceptually illustrating density patches formed on a conveying belt.

The density patch formation data memory area 23*b* stores density patch formation data used to form density patches C1-K5 shown in FIG. 4 on the conveying belt 68. Next, the content of the density patch formation data in the density patch formation data memory area 23*b* will be described with reference to FIG. 3.

FIG. 3 is a table showing the content in the density patch formation data memory area 23*b*. The density patch formation data stored in the density patch formation data memory area 23*b* is used to form the density patches C1-K5 on the conveying belt 68 initially. The density patch formation data for each patch C1-K5 includes a density patch name, a color of the density patch, a density of the patch, X and Y coordinates for the position at which the density patch is formed, and width and height of the patch. The density patch formation data includes data for a total of 20 patches, for the color, density, position, and dimensions of the patch in association with the density patch name.

A density patch name is assigned to each of the density patches C1-K5. In the embodiment, a total of 20 density patch names are provided from cyan 1 to black 5. The color indicates the color in which the density patches C1-K5 are formed. For example, when the color is cyan, the density patch is formed in the color cyan on the conveying belt 68. In the embodiment, density patches are formed in one of the four colors cyan, magenta, yellow, and black.

The density value specifies the density in which the density patches C1-K5 are to be formed. The density value can have a maximum value of 100% and a minimum value of 0%, a higher percentage resulting in a greater density of the density patch. A total of five density values are used in the embodiment: 100%, 80%, 60%, 40%, and 20%.

The patch width specifies a width of each density patch C1-K5. In the embodiment, all patch widths are set to a. The patch height specifies a height of each density patch C1-K5. In the embodiment, the height of all patches is set to b.

The X coordinate specifies a coordinate on a X-direction for forming the density patches C1-K5 (see FIG. 4). The X coordinate is set to X1 for all density patches in the embodiment. The Y coordinate specifies a coordinate on the Y-direction at which the density patches C1-K5 are to be formed (see FIG. 4). In the embodiment, the density patch formation data memory area 23*b* is preset with a total of 20 Y coordinates ranging from Y1 to Y20.

As shown in FIGS. 3 and 4, the Y coordinates indicating the position for forming a density patch are set by adding the patch height b of a preceding density patch to the Y coordinate for forming the preceding density patch. For example, the Y coordinate Y2 of the position for forming density patch M1 (density patch name: magenta 1) is calculated by adding the patch height b of density patch C1 (density patch name: cyan 1) to the Y coordinate Y1 at which the density patch C1 is formed. Accordingly, the density patches C1-K5 are formed on the conveying belt 68 (see FIG. 1) with no gaps therebetween.

The value of the Y coordinate is set as a counter value for a conveying distance counter 24*d* described later. The Y coordinate Y1 for cyan 1 (density patch C1) is set at least two times the patch height b away from a point at which the conveying distance counter 24*d* is zero (a starting point from which the conveying belt 68 is moved to form the density patches C1-K5 thereon). The coordinate Y1 is set in this way so that, when the conveying belt 68 completes one loop and returns to the starting point, at least one of the density patches C1-K5 can be formed between the starting point and the initial position for forming the density patches C1-K5 and so that this single density patch will not overlap the initial position in which the corresponding density patch was formed.

Figure 12A:
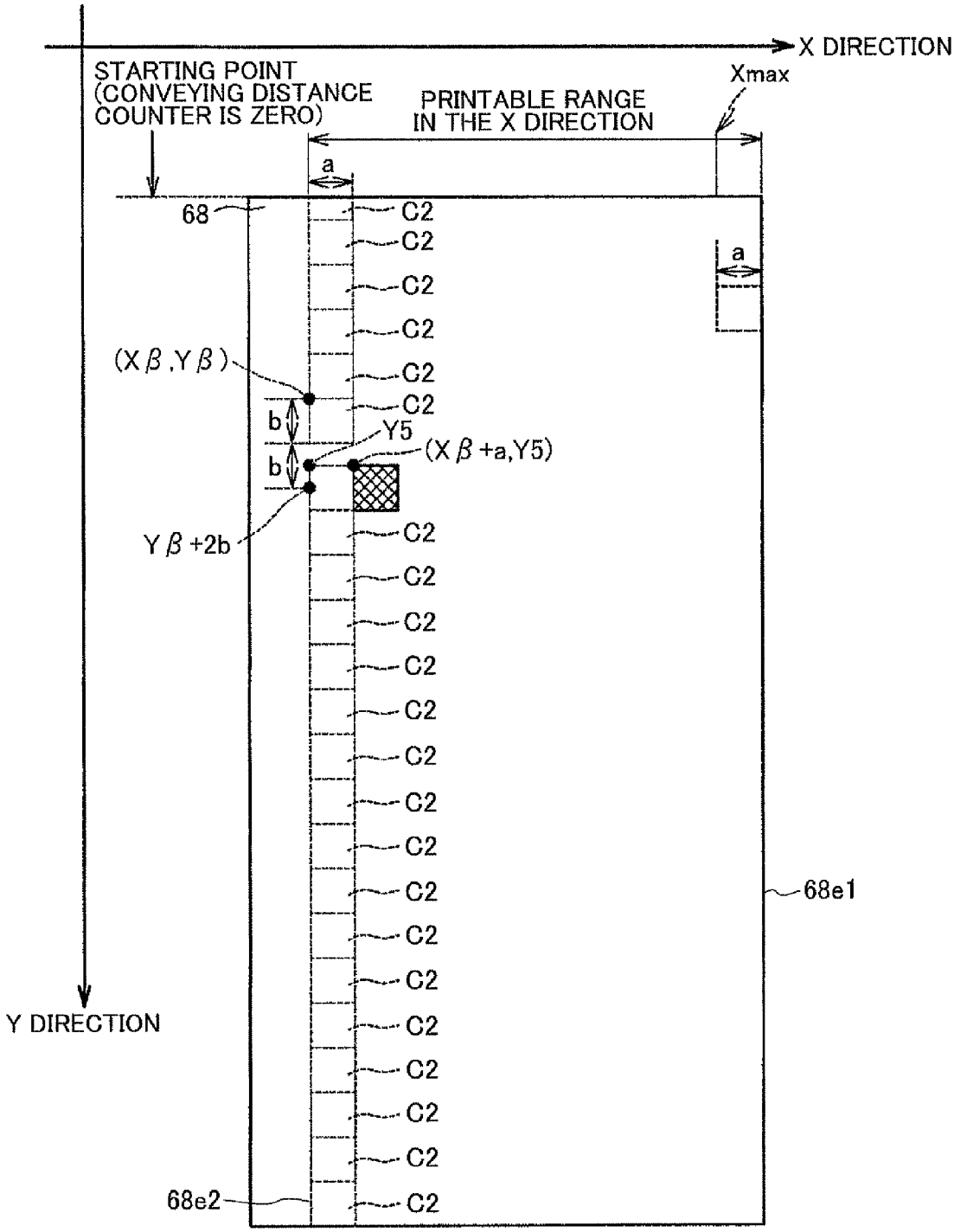
FIG. 12(*a*) is an explanatory diagram conceptually illustrating an example in which the formation position of a density patch is shifted by a patch width.
Figure 12B:
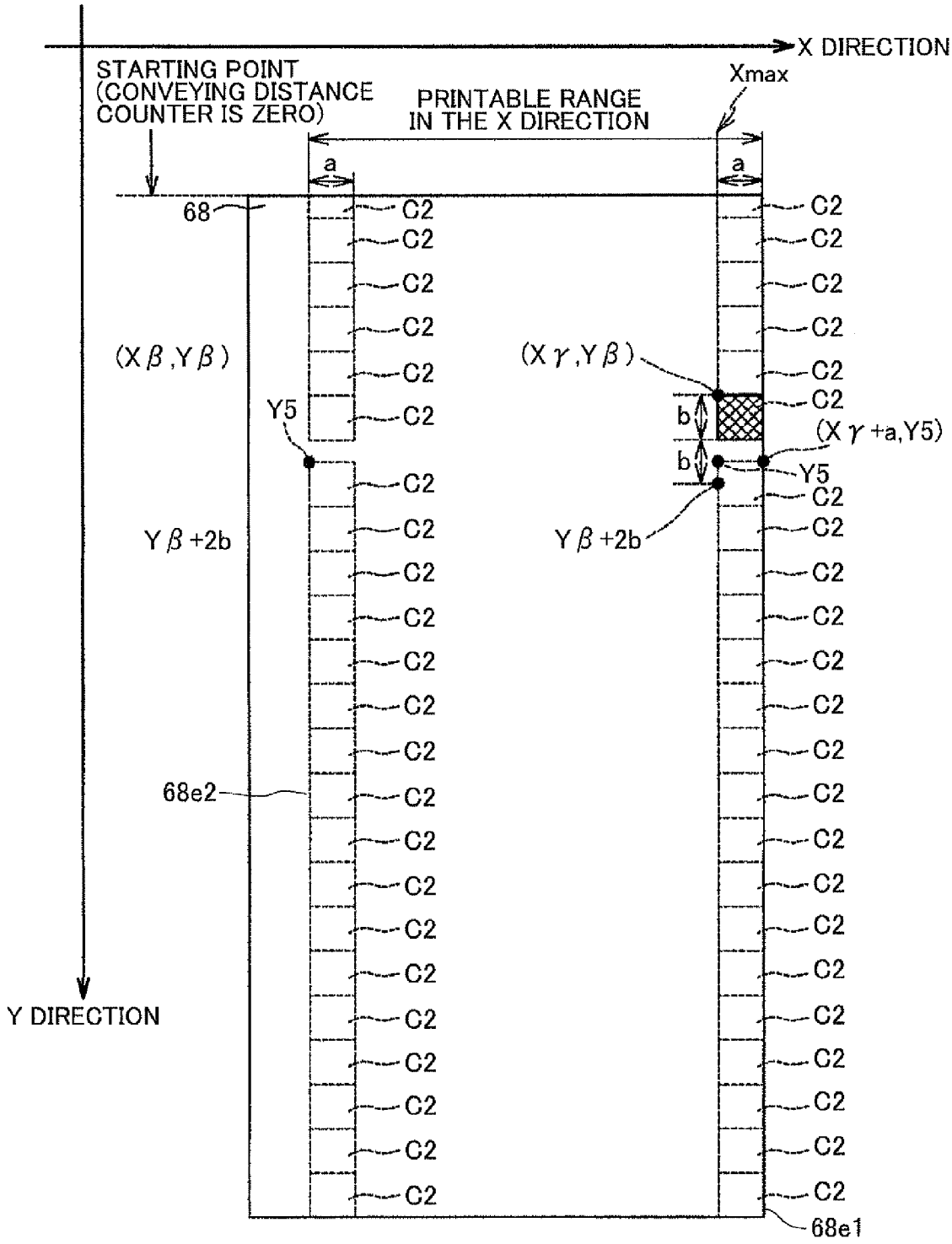

Here, FIG. 4 is an explanatory diagram conceptually illustrating the density patches C1-K5 formed on the conveying belt 68. In FIG. 12, the Y direction corresponds to the direction in which the conveying belt 68 moves, indicated by the arrow "a" in FIG. 1, while the X direction corresponds to a direction orthogonal to the surface of the drawing in FIG. 1 and parallel to the surface of the conveying belt 68. A printable range in the X direction denotes the region of the conveying belt 68 in which the density patches C1-K5 can be formed. Therefore, if the density patches C1-K5 are formed with one edge aligned with an end of the printable range in the X direction (the end farthest from the density sensor 80 shown in FIG. 4), the X coordinate for the density patches is an Xmax value calculated by subtracting the patch width a from the X coordinate at the end of the printable range. The Xmax value is the maximum value to which the X coordinate can be set.

Next, the formation of the density patches C1-K5 using the density patch formation data (see FIG. 3) stored in the density patch formation data memory area 23*b* (see FIG. 2) will be described. For example, when forming the density patch C1, the CPU 22 reads data from the density patch formation data memory area 23*b* for density patch name cyan 1 and forms the density patch C1 on the conveying belt 68 at the position indicated by X and Y coordinates X1 and Y1, in the color cyan, at a density of 100%, and with a width and height of a and b, respectively. Here, the X and Y coordinates determines a point Pc1 for positioning the density patch C1. Specifically, the X coordinate at the point Pc1 is X1, while the Y coordinate is Y1.

Further, when forming the density patch M3, for example, the CPU 22 reads data from the density patch formation data memory area 23*b* for the density patch name magenta 3 and forms the density patch M3 on the conveying belt 68 at the formation position indicated by X and Y coordinates X1 and Y10 (Y9+b), in the color magenta, at the density 60%, and with the patch width and height of a and b, respectively. The X and Y coordinates determine a point Pm3 for forming the density patch M3. Specifically, the X coordinate at the point Pm3 is X1, while the Y coordinate is Y10 (Y9+b=Y1+8b).

Hence, the CPU 22 forms a total of twenty density patches C1-K5 on the conveying belt 68, as shown in FIG. 4. Subsequently, the density sensor 80 measures the density of each of the density patches C1-K5.

Returning to FIG. 2, the normal value table memory area 23*c* stores a normal value table that is used for determining whether the densities of the density patches C1-K5 formed on the conveying belt 68 and measured by the density sensor 80 (see FIG. 1) are normal or abnormal.

As shown in FIG. 5, the normal value table stored in the normal value table memory area 23*c* is configured of maximum and minimum values for the density measured by the density sensor 80 in association with each density patch name. Accordingly, the normal value table is configured of 20 records in the embodiment.

The normal value table memory area 23*c* is used in a process for determining whether the densities measured by the density sensor 80 are normal or abnormal. After the density sensor 80 has measured the density patch C1, for example, the CPU 22 reads data from the normal value table memory area 23*c* for density patch name cyan 1. The CPU 22 determines whether the density of the density patch C1 measured by the density sensor 80 falls between the minimum and maximum values of the measured density read from the normal value table memory area 23*c* for cyan 1. Hence, if the density of the density patch C1 measured by the density sensor 80 is 0.9, the CPU 22 determines that the measured density is normal. However, if the density measured by the density sensor 80 is 1.1 or 0.7, the CPU 22 determines that the measured density is abnormal.

Similarly, after the density sensor 80 measures the density patch M3, the CPU 22 reads data from the normal value table memory area 23*c* for the density patch name magenta 3. If the density of the density patch M3 measured by the density sensor 80 is 0.5, the CPU 22 determines that the measured density is normal. However, if the density measured by the density sensor 80 is 0.8 or 0.3, the CPU 22 determines that the measured density is abnormal.

Returning to FIG. 2, the target data memory area 23*d* stores target density data used as target of calibration for each of the density patches C1-K5 formed on the conveying belt 68. The target data memory area 23*d* includes a cyan target data memory area 23*d*1, a magenta target data memory area 23*d*2, a yellow target data memory area 23*d*3, and a black target data memory area 23*d*4 corresponding to the four colors used to form the density patches C1-K5. Hence, target density data for cyan is stored in the cyan target data memory area 23*d*1, and target density data for yellow is stored in the yellow target data memory area 23*d*3. Calibration is performed using the target density data stored in the target data memory area 23*d* and measured densities for the density patches C1-K5 measured by the density sensor 80 to create calibration tables. The calibration tables are created in S26 of the calibration process of FIG. 8 and are stored in the calibration table memory area 25*a*.

Next, the content of the target data memory area 23*d* will be described with reference to FIG. 6(*a*). FIG. 6(*a*) shows the content of the cyan target data memory area 23*d*1 (see FIG. 2) and the content of a cyan measured density memory area 24*c*1 described later. While only the content of the cyan target data memory area 23*d*1 will be described with reference to FIG. 6(*a*), the content of the magenta target data memory area 23*d*2, yellow target data memory area 23*d*3, and black target data memory area 23*d*4 has the same structure as that of the cyan target data memory area 23*d*1, differing only in the values for the target density data stored therein.

The target density data for the color cyan stored in the cyan target data memory area 23*d*1 (hereinafter abbreviated to "cyan target density data") is configured of the density patch name and cyan target density for each of the density patches C1-C5. Since the cyan target density is stored in association with the density patch name, the cyan target density data includes five records. The cyan target densities in the cyan target density data are set to the densities of the density patches C1-C5 measured by the density sensor 80 in the factory prior to shipping.

The cyan target density data indicates the cyan target densities corresponding to the set densities of the density patches C1-C5. For example, since the density patch C1 has a set density of 20%, the cyan target density is 0.20. Further, since the density patch C3 has a set density of 60%, the cyan target density is set to 0.60.

After the density patches C1-K5 are formed on the conveying belt 68, the density sensor 80 measures the density of the density patch C1, which has the set density of 20%.

Returning to FIG. 2, the RAM 24 has calibration flags 24*a*, an error density patch formation data memory area 24*b*, a measured density memory area 24*c*, and a conveying distance counter 24*d*.

The calibration flags 24*a* indicate abnormal measured densities when the CPU 22 determines that the measured densities for the density patches C1-K5 do no fall between the upper and lower limits of measured densities in the normal value table stored in the normal value table memory area 23*c* and are thus abnormal measured densities. The calibration flags 24*a* include cyan 1-5 error flags 24*a*11-24*a*15, magenta 1-5 error flags 24*a*21-24*a*25, yellow 1-5 error flags 24*a*31-24*a*35, and black 1-5 error flags 24*a*41-24*a*45 corresponding to the colors of the density patches C1-K5. For example, the cyan 1 error flag 24*a*11 is in correspondence with the density patch C1, and the magenta 3 error flag 24*a*23 is in correspondence with the density patch M3. Accordingly, if the CPU 22 determines that the measured density of the density patch C1 is abnormal, the CPU 22 sets the cyan 1 error flag 24*a*11 to ON. If the CPU 22 determines that the measured density of the density patch M3 is abnormal, the CPU 22 sets the magenta 3 error flag 24*a*23 to ON.

If the CPU 22 subsequently determines that the measured density of one of the density patches C1-K5 is abnormal, i.e., does not fall between the upper and lower limits of measured densities in the normal value table stored in the normal value table memory area 23*c*, then the CPU 22 sets the corresponding calibration flag 24*a* to ON. On the other hand, if the CPU 22 determines that the density of one of the measured density patches C1-K5 is normal, i.e., falls between the upper and lower limits of measured densities in the normal value table stored in the normal value table memory area 23*c*, then the CPU 22 sets the corresponding calibration flag 24*a* to OFF.

The error density patch formation data memory area 24*b* stores positions on the conveying belt 68 for re-forming any of the density patches C1-K5 whose measured density was determined to be abnormal by the CPU 22. The error density patch formation data memory area 24*b* is initially identical to that of the density patch formation data memory area 23*b*. If the CPU 22 subsequently determines that the measured density for one of the density patches C1-K5 is abnormal, the CPU 22 updates the content in the error density patch formation data memory area 24*b* each time the density patch found to have an abnormal measured density is re-formed.

The measured density memory area 24*c* stores the measured density of each density patch C1-K5. The measured density memory area 24*c* includes a cyan measured density memory area 24*c*1, a magenta measured density memory area 24*c*2, a yellow measured density memory area 24*c*3, and a black measured density memory area 24*c*4 corresponding to the colors in which the density patches C1-K5 are formed. Hence, when the density sensor 80 measures the densities of the cyan density patches C1-C5, for example, the measured densities are stored in the cyan measured density memory area 24*c*1, and when the density sensor 80 measures the densities of the yellow density patches Y1-Y5, for example, the measured densities are stored in the yellow measured density memory area 24*c*3. Measured densities stored in the measured density memory area 24*c* are updated each time the density sensor 80 measures the density of one of the density patches C1-K5.

Next, the content of the measured density memory area 24*c* will be described with reference to FIG. 6(*a*). FIG. 6(*a*) shows the content of the cyan target data memory area 23*d*1 and the cyan measured density memory area 24*c*1. While the content of the cyan measured density memory area 24*c*1 will be described with reference to FIG. 6(*a*), the content of the magenta measured density memory area 24*c*2, yellow measured density memory area 24*c*3, and black measured density memory area 24*c*4 are identical in structure to that of the cyan measured density memory area 24*c*1, except for the values of the measured density.

The cyan measured density data stored in the cyan measured density memory area 24*c*1 is configured of the density patch names for density patches C1-C5 and their corresponding densities measured by the density sensor 80. Since the measured densities are stored in association with the density patch names, the cyan measured density data indicates the measured densities of the density patches C1-C5. For example, the measured density of the density patch C1 is 0.15, while the set density is 20%. Further, the measured density of the density patch C3 is 0.40, while the set density is 60%.

Returning to FIG. 2, the conveying distance counter 24*d* is used for finding the rotated amount of the drive roller 63 (see FIG. 1), i.e., the conveying distance of the conveying belt 68 in the Y direction (see FIG. 4). The conveying distance counter 24*d* is reset to zero when the calibration process starts. The value of the conveying distance counter 24*d* (hereinafter, referred to "counter value") is subsequently incremented each time the conveying belt 68 moves a prescribed distance in the Y direction. A maximum value for the conveying distance counter 24*d* is set to a distance in which the conveying belt 68 makes one complete circuit after the conveying distance counter 24*d* starts counting. When the conveying belt 68 makes a complete circuit, the value counter of the conveying distance counter 24*d* is reset to zero. The counter value of the conveying distance counter 24*d* is the Y coordinate for patch forming positions stored in the density patch formation data memory area 23*b* (see FIG. 3) and the error density patch formation data memory area 24*b* (see FIG. 3(*b*)). The CPU 22 initiates formation of each of the density patches C1-K5 when the counter value reaches the Y coordinate in each patch forming position.

The Y coordinate Y1 indicating the position for forming the density patch C1 (see FIG. 3) is set by the counter value of the conveying distance counter 24*d*. As an example, the Y coordinate Y1 for forming the density patch C1 is set to 5 in terms of the count value of the conveying distance counter 24*d*. Therefore, since the Y coordinate Y2 for forming the density patch M1 is Y1+b (see FIG. 3), if the patch height b is set to 3 in terms of count values of the conveying distance counter 24*d*, then the Y2 is set to a count value of 8 (Y2=Y1+b=5+3). In this way, Y coordinates stored in the density patch formation data memory area 23*b* are set based on count values of the conveying distance counter 24*d*. Y coordinates stored in the error density patch formation data memory area 24*b* also are set based on count values of the conveying distance counter 24*d*.

The flash memory 25 has a calibration table memory area 25*a*. The calibration table memory area 25*a* stores calibration tables for determining the degree to which set densities for the density patches C1-K5 should be calibrated based on measured densities of the density patches C1-K5 formed on the conveying belt 68.

The calibration table memory area 25*a* includes a cyan calibration table memory area 25*a*1, a magenta calibration table memory area 25*a*2, a yellow calibration table memory area 25*a*3, and a black calibration table memory area 25*a*4 corresponding to the colors of each the density patches C1-K5.

Next, the content of the cyan calibration memory area 25*a*1 will be described with reference to FIG. 6(*c*). The cyan calibration table stored in the cyan calibration memory area 25*a*1 is configured of set densities and calibrated set densities. Since the calibrated set densities are stored in association with the set densities, the cyan calibration table in the embodiment is configured of six records. The calibrated set density for the set density of 0% is fixed at the preset value of 0%.

Figures 6C, 7:
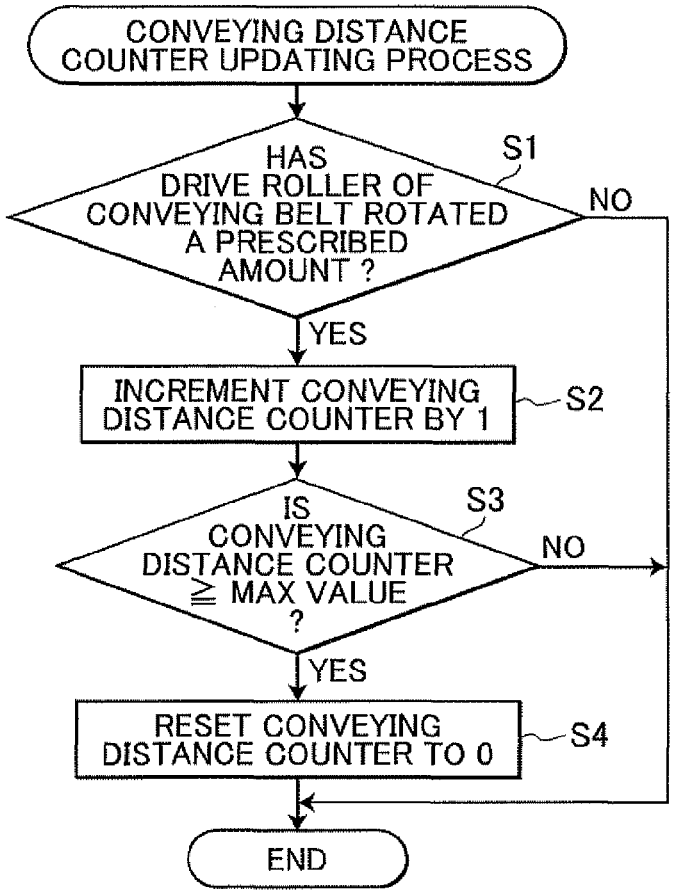
FIG. 7 is a flowchart illustrating steps in a conveying distance counter updating process executed by a CPU in a controller of the color laser printer.

FIG. 7 is a flowchart illustrating steps in a conveying distance counter updating process. The conveying distance counter updating process is performed to update the rotational amount of the drive roller 63 (see FIG. 1), i.e., to update the counter value of the conveying distance counter 24*d* for finding the conveying distance in the Y direction of the conveying belt 68 (Y coordinate; see FIG. 4). The CPU 22 of the controller 90 executes this process periodically at intervals of 2 ms, for example, while the power to the laser printer 1 is on.

In S1 of the conveying distance counter updating process, the CPU 22 determines whether the drive roller 63 has rotated a prescribed amount. The CPU 22 reaches a YES determination in S1 when a stepping motor (not shown) has been driven a prescribed number of steps for rotating the drive roller 63 with a rotational drive force. The CPU 22 detects an encoder waveform of the stepping motor (DC motor) as the DC motor is driven to rotate the drive roller 63 to determine whether the drive roller 63 has rotated the prescribed amount.

When the CPU 22 determines that the drive roller 63 has been rotated the prescribed amount (equivalent to a prescribed amount of the conveying distance of the conveying belt 68 in the Y direction indicated by the Y coordinate; S1: YES), then in S2 the CPU 22 increments the count value of the conveying distance counter 24*d* by one (1). In S3 the CPU 22 determines whether the counter value of the conveying distance counter 24*d* is greater than or equal to the max value. The max value is the maximum count value for the conveying distance counter 24*d* and denotes that the conveying belt 68 has moved in one complete circuit from the point that the conveying distance counter 24*d* began counting. If the CPU 22 determines that the conveying belt 68 has moved one complete circuit based on the value of the conveying distance counter 24*d* reaching or exceeding the max value (S3: YES), then in S4 the CPU 22 resets the value of the conveying distance counter 24*d* to zero. Accordingly, in S4 the CPU 22 initializes the conveying distance of the conveying belt 68 in the Y direction (Y coordinate). Subsequently, the CPU 22 ends the conveying distance counter updating process.

However, if the CPU 22 determines that the drive roller 63 has not rotated the prescribed amount (S1: NO) or if the CPU 22 determines that the counter value of the conveying distance counter 24*d* is less than the max value (S3: NO), indicating that the conveying belt 68 has not yet moved in a complete circuit, the CPU 22 ends the conveying distance counter updating process without resetting the counter value to zero.

Through the conveying distance counter updating process, the CPU 22 can find the rotational amount of the drive roller 63, i.e., the conveying distance of the conveying belt 68 in the Y direction (Y coordinate).

Next, a calibration process executed by the CPU 22 of the controller 90 will be described with reference to FIG. 8. FIG. 8 is a flowchart illustrating steps in the calibration process. The CPU 22 executes the calibration process when the user operates the operation keys 108.

In S10 at the beginning of the calibration process, the CPU 22 resets the counter value of the conveying distance counter 24*d* to zero, thereby initializing the conveying distance of the conveying belt 68 in the Y direction (Y coordinate).

In S11 the CPU 22 initializes all of the calibration flags 24*a* to OFF. In S12 the CPU 22 transfers the density patch formation data stored in the density patch formation data memory area 23*b* (see FIG. 3) to the error density patch formation data memory area 24*b*. In S13 the CPU 22 reads the density patch formation data from the error density patch formation data memory area 24*b*, and forms each of the density patches C1-K5 on the conveying belt 68 based on the density patch formation data from the error density patch formation data memory 24*b*. Since the Y coordinate stored in the error density patch formation data memory 24*b* is set based on the counter value of the conveying distance counter 24*d*, the counter value is used as the Y coordinate when forming the density patches C1-K5 on the conveying belt 68.

In S14 the CPU 22 measures the densities of the density patches C1-K5 using the density sensor 80 and in S15 stores the measured density data in the measured density memory area 24c corresponding to the colors of density patches C1-K5. Through the process of S15, the CPU 22 stores measured density data for each of the density patches C1-C5 in the cyan measured density memory area 24c1, measured density data for the density patches M1-M5 in the magenta measured density memory area 24c2, measured density data for the density patches Y1-Y5 in the yellow measured density memory area 24c3, and measured density data for the density patches K1-K5 in the black measured density memory area 24c4.

In S16 the CPU 22 reads one of the measured density data records stored in the measured density memory area 24c. For example, the CPU 22 reads measured density data for the density patch C1 from the cyan measured density memory area 24c1. In S17 the CPU 22 reads the normal value table corresponding to the density patch name of the measured density data read in S16 from the normal value table memory area 23c. When measured density data for the density patch C1 was read in S16, for example, the density patch name is cyan 1 (see FIG. 6(a)). Accordingly, the CPU 22 reads the normal value table corresponding to cyan 1 (see FIG. 5) from the normal value table memory area 23c.

In S18 the CPU 22 determines whether the measured density data read in S16 falls within the range of values in the normal value table. For example, if the value of the measured density data for the density patch C1 is 0.9 and the range of values in the normal value table is a range between the lower limit 0.8 and upper limit 1.0 (see FIG. 5), then the CPU 22 determines in S18 that the measured density data falls within the range of values in the normal value table (S18: YES). However, if the measured density data for the density patch C1 is 0.7 or 1.1, then the CPU 22 determines in S18 that the measured density data does not fall within the values in the normal value table (S18: NO).

If the CPU 22 determines that the measured density data read in S16 falls outside the range of values in the normal value table (S18: NO), then in S19 the CPU 22 sets the calibration flag 24a corresponding to the density patches C1-K5 associated with the measured density data in question to ON. For example, if measured density data for the density patch C1 is being processed, the cyan 1 error flag 24a11 corresponding to the density patch C1 is set to ON.

In this way, the CPU 22 determines whether the density for the density patch measured by the density sensor 80 falls within the range of values in the normal value table stored in the measured density memory area 24c for the same density patch. Therefore, the CPU 22 can determine whether the measured density falls within a suitable range of densities, without performing a special data process.

On the other hand, if the CPU 22 determines that the measured density data read in S16 falls within the normal range (S18: YES), or after the CPU 22 performs the process in S19, in S20 the CPU 22 determines whether the process has been completed for all measured density data. Specifically, the CPU 22 determines whether the process in S16-S19 has been performed for all measured density data corresponding to the density patches C1-K5. The CPU 22 returns to S16 upon determining that the process has not been completed for all measured density data (S20: NO) and advances to S21 upon determining that the process has been completed for all measured density data (S20: YES).

In S21 the CPU 22 determines whether all of the calibration flags 24a are set to OFF. The CPU 22 reaches a NO determination in S21 if an error occurred for any of the calibration flags 24a (for example, even if only the cyan 2 error flag 24a12 is ON). If the CPU 22 determines that any one of the calibration flags 24a is not off (S21: NO), then in S22 the CPU 22 displays a message on the display unit 109 indicating that calibration was abnormal. Since the CPU 22 must perform the calibration retry process in S23 described later when an error has been indicated by any of the calibration flags 24a, resulting in a relatively long processing time for calibration, the CPU 22 displays a message on the display unit 109 indicating this situation so that the user does not misinterpret the extended processing time as a malfunction of the laser printer 1.

FIG. 9 is a flowchart illustrating steps in S23 of the calibration retry process. In S30 the CPU 22 acquires data for one of the calibration flags 24a. As an example, the CPU 22 acquires data for the cyan 1 error flag 24a11 in S30.

In S31 the CPU 22 determines whether the acquired calibration flag 24a is ON. For example, the CPU 22 reaches a NO determination in S31 if the CPU 22 acquired the cyan 1 error flag 24a11 in S30 and the cyan 1 error flag 24a11 is set to OFF. However, the CPU 22 reaches a YES determination in S31 if the CPU 22 acquired the cyan 2 error flag 24a12 in S30 and the cyan 2 error flag 24a12 is set to ON.

If the CPU 22 determines that the calibration flag 24a acquired in S30 is OFF (S31: NO), then in S40 the CPU 22 determines whether all calibration flags 24a have been checked. If not all calibration flags 24a have been checked (S40: NO), the CPU 22 returns to S30. However, if the CPU 22 determines that all calibration flags 24a have been checked (S40: YES), indicating that all calibration flags 24a are off, the CPU 22 ends the calibration retry process.

When the CPU 22 determines in S31 that the acquired calibration flag 24a is ON (S31: YES), then in S32 the CPU 22 reads density patch formation data for the density patch in question (the single density patch corresponding to the calibration flag 24a acquired in S30) from the error density patch formation data memory area 24b. In S33 the CPU 22 adds the patch height b for forming the density patch to the Y coordinate in the density patch formation data read in S32, updates the density patch formation data, and stores the updated data in the error density patch formation data memory area 24b. In S34 the CPU 22 acquires the density patch formation data from the error density patch formation data memory area 24b that was newly updated for the density patch in question and forms this density patch on the conveying belt 68 based on the density patch formation data.

As an example, the CPU 22 acquires the cyan 2 error flag 24a12 in S30 and determines that the cyan 2 error flag 24a12 is ON (S31: YES). In S32 the CPU 22 reads density patch formation data for density patch C2 (cyan 2) from the error density patch formation data memory area 24b. In S33 the CPU 22 adds the patch height b to the Y coordinate in the density patch formation data (Y5), updates the Y coordinate to (Y6=Y5+b), and stores the updated density patch formation data in the error density patch formation data memory area 24b. In S34 the CPU 22 acquires the updated density patch formation data for the density patch C2 from the error density patch formation data memory area 24b and forms the density patch C2 on the conveying belt 68 based on this updated density patch formation data stored in the cyan density patch formation data memory area 23d.

Through the process of S32 and S33, the CPU 22 modifies only the Y coordinate in the position for forming the density patch C2 on the conveying belt 68, without changing the X coordinate. Hence, in S33 the position on the conveying belt 69 at which the density patch C2 is re-formed is adjusted by the patch height b from the position on the conveying belt 68 at which the density patch C2 is formed in S13 of FIG. 8. In S34 the CPU 22 forms the density patch C2 at the new position modified from the original position by the patch height b.

Figure 10A:
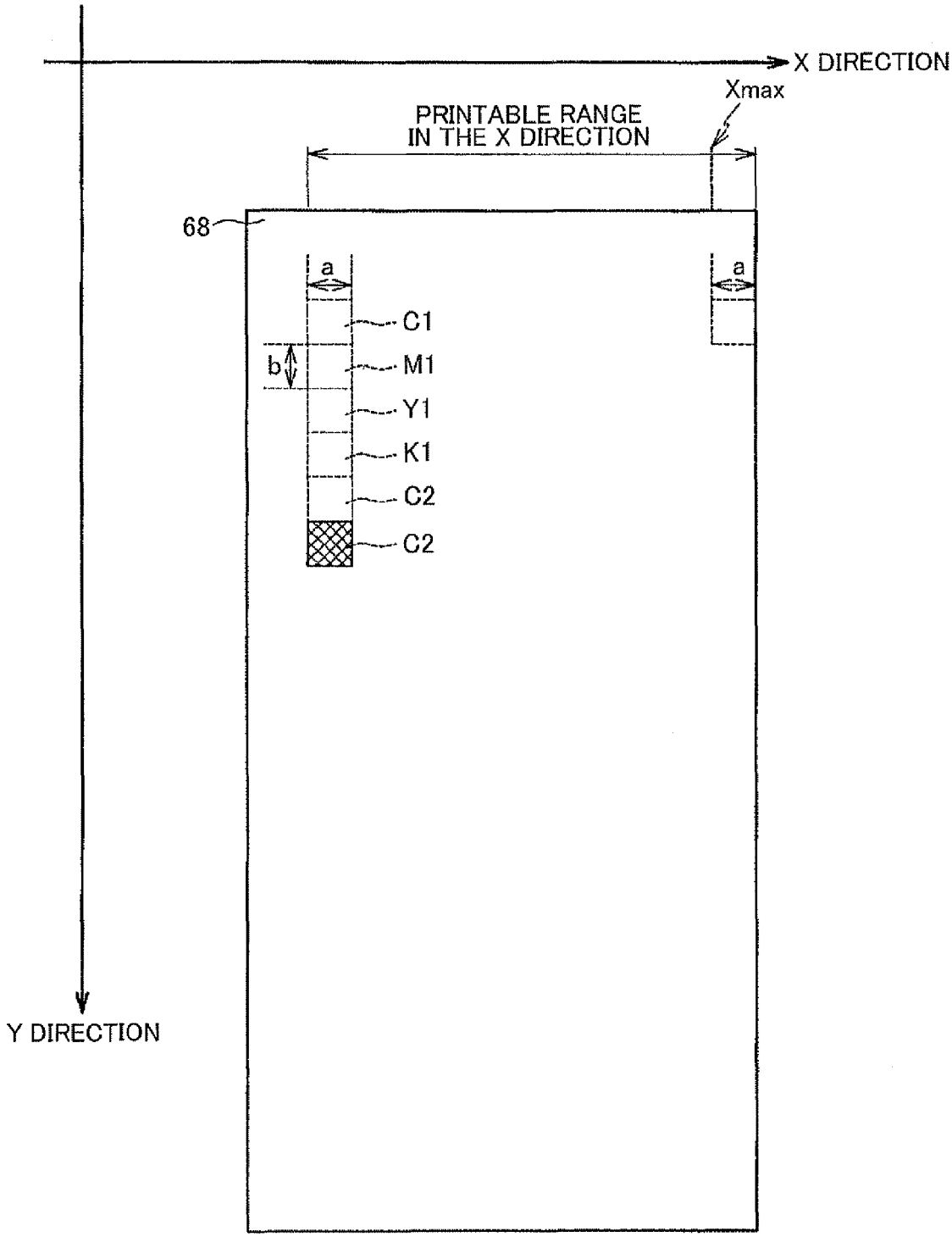
FIGS. 10(*a*) and 10(*b*) are explanatory diagrams conceptually illustrating density patches re-formed on the conveying belt.
Figure 10B:
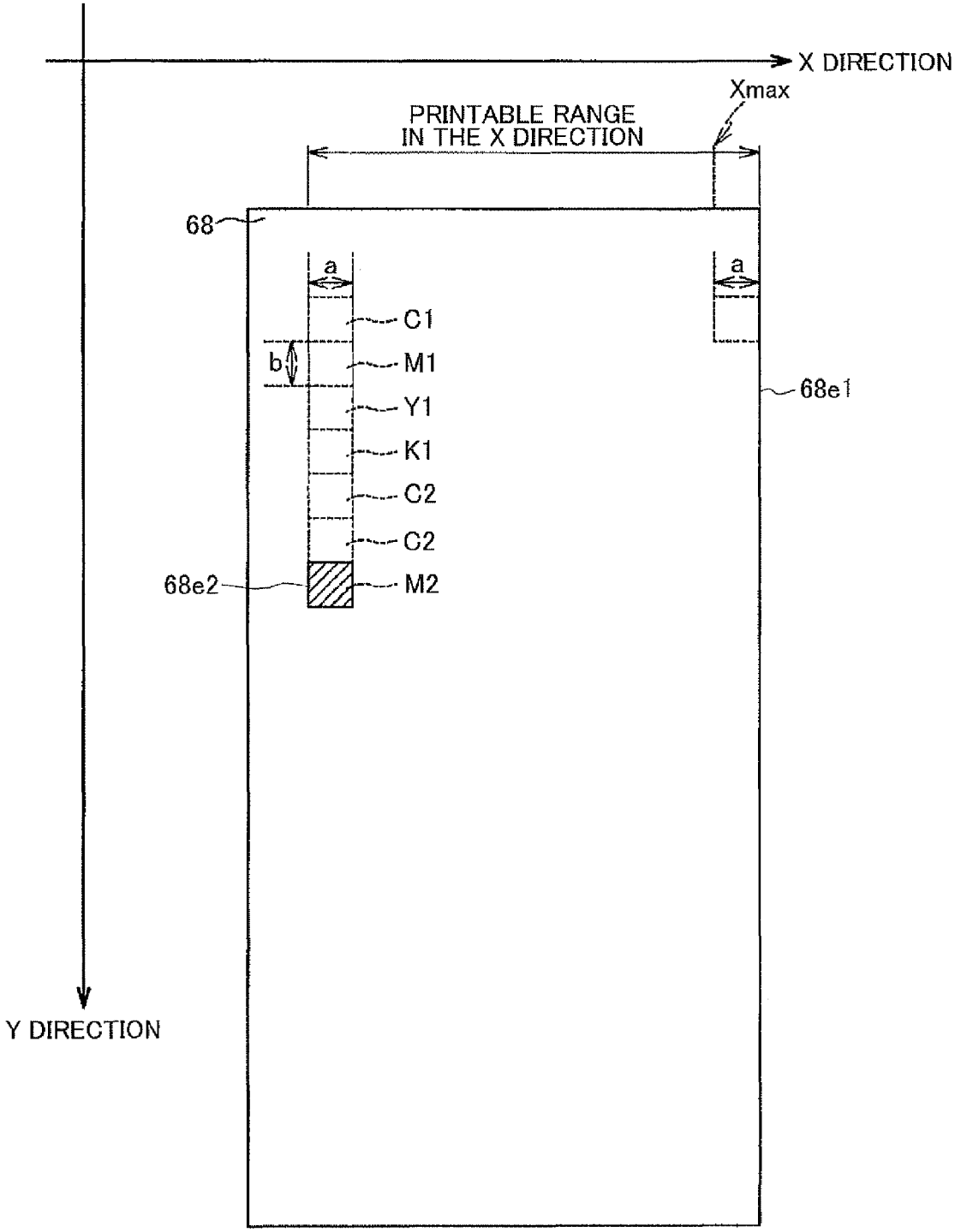

Next, the process of S30-S34 will be described while referring to FIG. 10(*a*). FIG. 10(*a*) conceptually illustrates a density patch C2 that has been re-formed on the conveying belt 68. The region from density patches C1 through C2 outlined by a dotted line indicates the position at which the density patches C1 through C2 were formed in S13 of FIG. 8. When executing the calibration retry process after forming density patches C1-K5 in S13 of FIG. 8, the conveying belt 68 has moved a complete circuit (see S33 and S34) while the cleaning brush 105 (see FIG. 1) scrapes off all the density patches C1-K5. However, density patches C1 through C2 have been indicated with a dotted line to reveal their formation positions.

Since the cyan 2 error flag 24*a*12 is set to ON in this example, in S32-S34 of FIG. 9 the CPU 22 re-forms the density patch C2 at a new position (position of the density patch C2 indicated with hatch marks in FIG. 10(*a*)) shifted exactly the patch height b from the position at which the density patch C2 was initially formed on the conveying belt 68 (position of the density patch C2 displayed above the density patch C2 with hatch marks in FIG. 10(*a*)).

The position at which the density patch C2 is re-formed on the conveying belt 68 is shifted the patch height b from the initial position of the density patch C2 to prevent the new density patch C2 from overlapping the position of the previous density patch C2. Accordingly, if the density patch C2 was previously formed in a region of the conveying belt 68 having tears or deflection, the new density patch C2 can be re-formed at a different position on which the density patch C2 was formed, thereby increasing the probability that the density sensor 80 will properly measure the density of the density patch C2.

Returning to FIG. 9, in S35 the density sensor 80 measures the density of the density patch that was formed in S34 (one of the density patches C1-K5 corresponding to the calibration flag 24*a* of ON judged in S31) and the CPU 22 stores the measured density data in the measured density memory area 24*c*. For example, when the density patch C2 was formed in S34 (see FIG. 10(*a*)), in S35 the density sensor 80 measures the density of the density patch C2 and the CPU 22 stores the measured density data in the cyan measured density memory area 24*c*1.

In S36 the CPU 22 reads the measured density data for the density patch currently undergoing processing from the measured density memory area 24*c* and in S37 reads the normal value table corresponding to the density patch name of the measured density data read in S36 from the normal value table memory area 23*c*. In S38 the CPU 22 determines whether the measured density data read in S36 falls within the range of values indicated in the normal value table.

As an example of FIG. 10(*a*), in S36 the CPU 22 reads the cyan measured density data for the density patch C2 from the cyan measured density memory area 24*c*1 and in S37 reads the normal value table (see FIG. 5) corresponding to the density patch C2 (cyan 2) from the normal value table memory area 23*c*. Since the range of values in the normal value table for the density patch C2 has a tower limit of 0.6 and an upper limit of 0.9 for the measured density, if the value of the cyan measured density data for the density patch C2 is 0.7, then the CPU 22 determines that the cyan measured density data read in S36 falls within the range of normal values (S38: YES). However, if the cyan measured density data for the density patch C2 is 0.5 or 1.0, for example, then the CPU 22 determines that the cyan measured density data falls outside the range of normal values (S38: NO).

When the CPU 22 determines that the measured density data falls within the range of normal values in the table (S38: YES), then in S39 the CPU 22 sets the calibration flag 24*a* corresponding to the density patch whose measured density data is being processed to OFF, and advances to S40. For example, if the CPU 22 determines in S38 that the measured density data for the density patch C2 falls within the range of values in the normal value table (S38: YES), then in S39 the CPU 22 sets the cyan 2 error flag corresponding to the density patch C2 to OFF.

The CPU 22 determines in S40 all the calibration flags 24*a* has been checked (S40: YES), the CPU 22 ends the calibration retry process. However, if the CPU 22 determines in S40 that not all the calibration flags 24*a* have been checked (S40: NO), the CPU 22 returns to S30.

After returning to S30, the CPU 22 again acquires data from one of the calibration flags 24*a* and in S31 determines whether the calibration flag 24*a* is ON. As an example, in S30 the CPU 22 acquires the magenta 2 error flag 24*a*22. If the magenta 2 error flag 24*a*22 is ON (S31: YES), then the CPU 22 performs the process from S32. Here, the magenta 2 error flag 24*a*22 corresponds to the density patch M2.

The process of S32-S34 will be described with reference to FIG. 10(*b*) for the case in which the CPU 22 returns to S30 and determines in S31 that the magenta 2 error flag 24*a*22 is ON (S31: YES). FIG. 10(*b*) conceptually illustrates the density patch M2 formed on the conveying belt 68. The example in FIG. 10(*b*), assumes that the magenta 2 error flag 24*a*22 was acquired in S30 of FIG. 9 after the density patch C2 was re-formed according to the process in S30-S34 of FIG. 9.

When the magenta 2 error flag 24*a*22 acquired in S30 of FIG. 9 is ON, the CPU 22 forms the density patch M2 at a new position (Y7=Y6+b) (indicated by the density patch M2 with hatching marks in FIG. 10(*b*)) shifted the patch height b from the position (Y6) at which the density patch M2 was initially formed on the conveying belt 68 (the position of the density patch C2 directly above the density patch M2 shown with hatching marks in FIG. 10(*b*), i.e., the position at which the density patch M2 was initially formed on the conveying belt 68).

In this way, if a plurality of calibration flags 24*a* are ON (at least the cyan 2 error flag 24*a*12 and magenta 2 error flag 24*a*22 in the above example), the CPU 22 re-forms each of the density patches for which the calibration flag 24*a* acquired in S30 were ON. Accordingly, the density sensor 80 can measure the density for the re-formed density patches one at a time. Hence, with the laser printer 1 of the embodiment, the density sensor 80 need not recognize the formation positions of the re-formed density patches, thereby simplifying density measurements of the density patches with the density sensor 80.

When the CPU 22 determines in S38 of FIG. 9 that the measured density data does not fall within the range of values in the normal value table (S38: NO), then in S41 the CPU 22 determines whether the Y coordinate stored in the error density patch formation data memory area 24*b* for the position at which the density patch in question was formed is less than the Y coordinate stored in the density patch formation data memory area 23*b* for the position at which the same density patch was initially formed. The process of S41 will be described in detail with reference to FIGS. 11(*a*) and 11(*b*).

Figure 11A:
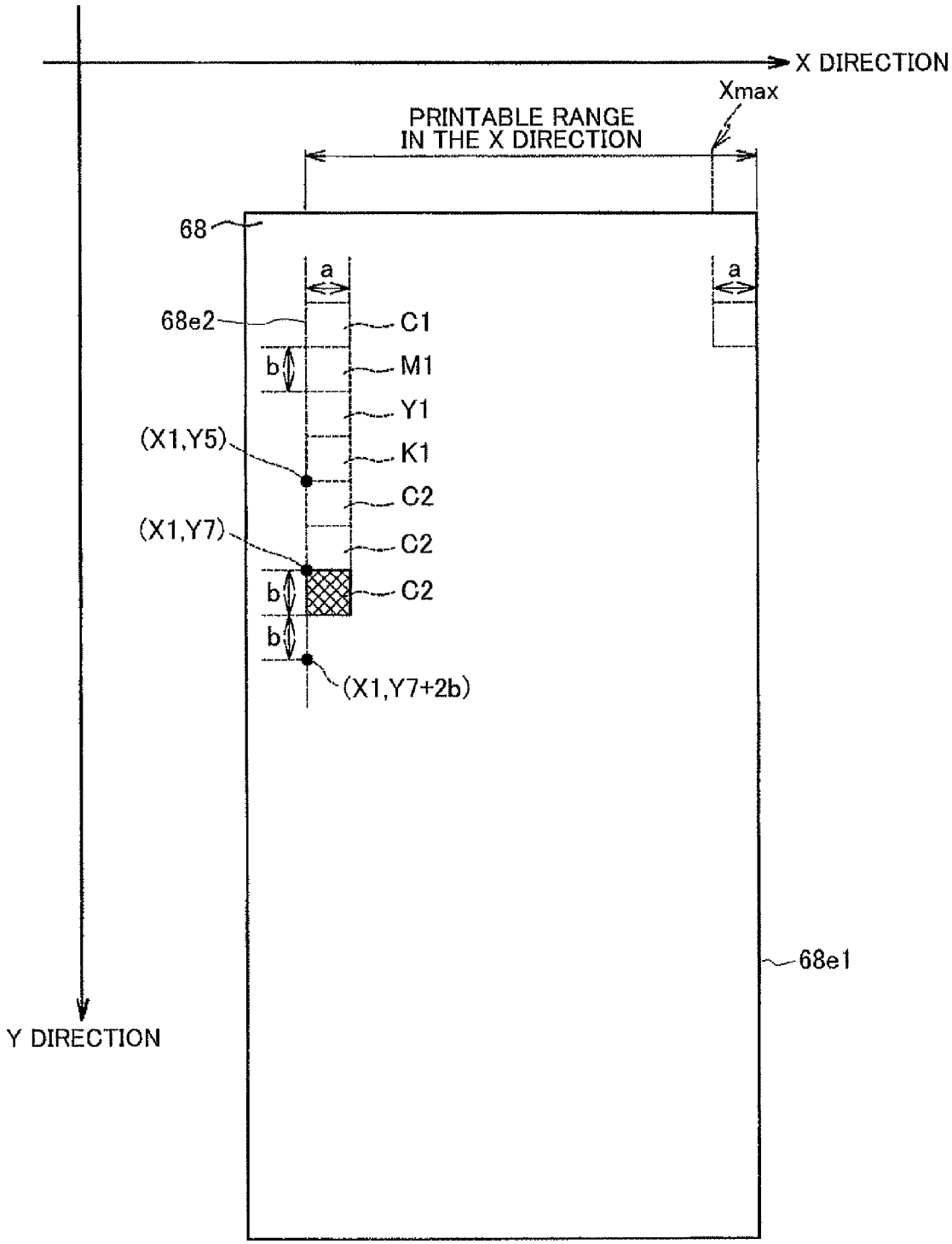
FIGS. 11(*a*) and 11(*b*) are explanatory diagrams conceptually illustrating density patches re-formed on the conveying belt.
Figure 11B:
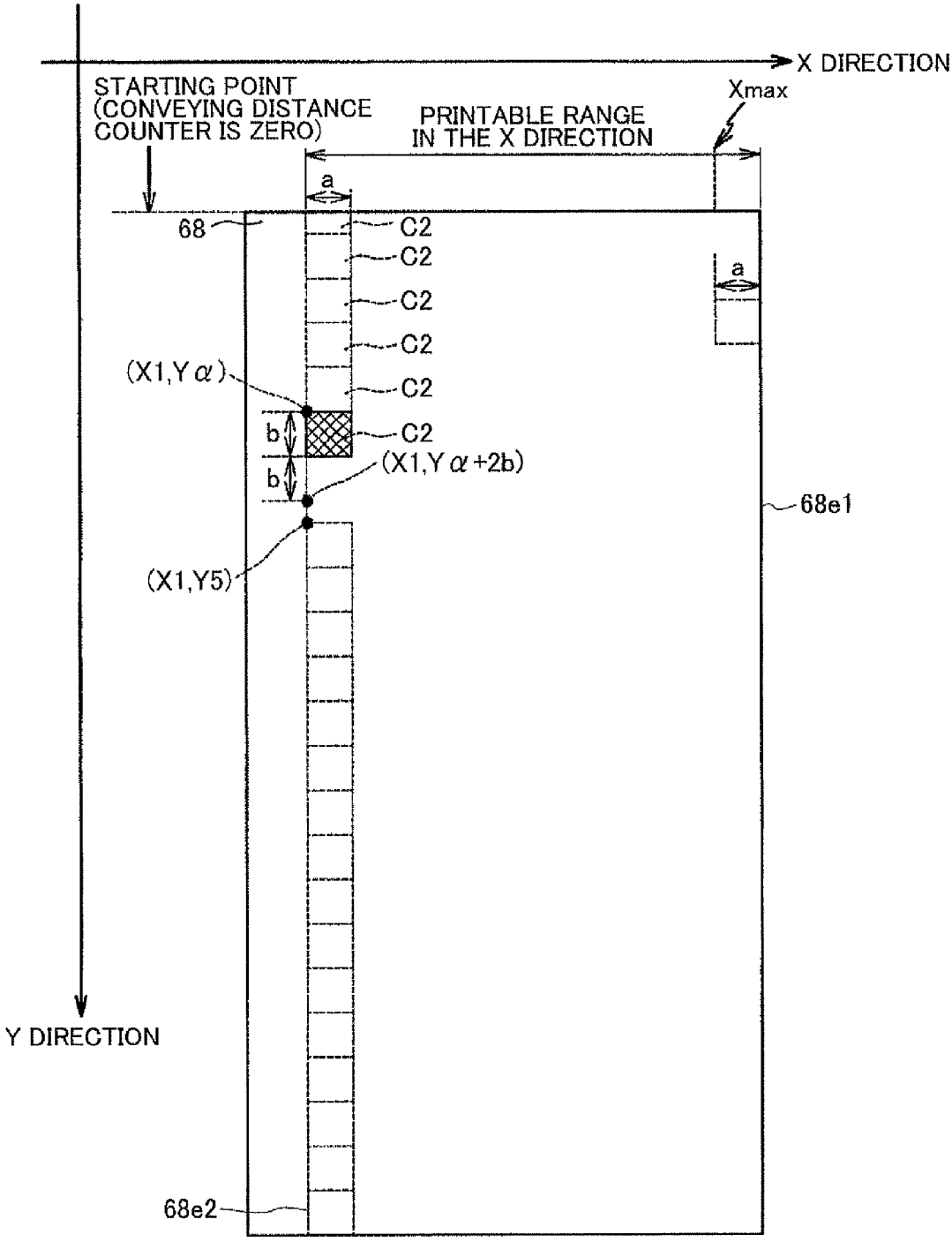

FIG. 11(*a*) shows an example in which the CPU 22 reaches a NO determination in S41 of FIG. 9, and FIG. 11(*b*) shows an example in which the CPU 22 reaches a YES determination in S41 of FIG. 9. Both examples in FIGS. 11(*a*) and 11(*b*) are described for the density patch C2. In FIG. 11(*a*), it is assumed that the density patch C2 has already been re-formed twice in S32-S34 of FIG. 9. In FIG. 11(*b*), it is assumed that the density patch C2 has already been re-formed a plurality of times in S32-S34 of FIG. 9.

First, the example in which the CPU 22 reaches a NO determination in S41 will be described with reference to FIG. 11(*a*). In this example, the Y coordinate Y7 stored in the error density patch formation data memory area 24*b* for the formation position of the density patch C2 (the density patch C2 with hatching marks in FIG. 11(*a*)) is greater than the Y coordinate Y5 stored in the density patch formation data memory area 23*b* for the formation position of the density patch C2 (the density patch C2 initially printed on the conveying belt 68). Accordingly, the CPU 22 reaches a NO determination in S41 of FIG. 9. In other words, the CPU 22 determines that the density patch C2 re-formed twice by repeatedly performing the process in S32-S41 of FIG. 9 has not yet surpassed the starting point on the conveying belt 68 (the point at which the value of the conveying distance counter 24*d* counting the amount of movement of the conveying belt 68 is 0). Therefore, there is no chance that the formation position of the next density patch C2 will overlap the Y coordinate Y5 at which the density patch C2 was initially printed on the conveying belt 68. By reaching a NO determination in S41 of FIG. 9, the CPU 22 returns to S32 in order to re-form the density patch C2 a third time.

Next, the case in which the CPU 22 reaches a YES determination in S41 of FIG. 9 will be described. In this example, the Y coordinate Yα stored in the error density patch formation data memory area 24*b* where the formation position of the density patch C2 (the density patch C2 with hatching marks in FIG. 11(*b*)) is smaller than the Y coordinate Y5 stored in the density patch formation data memory area 23*b* for the formation position of the density patch C2 (the density patch C2 initially printed on the conveying belt 68). Therefore, the CPU 22 reaches a YES determination in S41 of FIG. 9. In other words, the CPU 22 determines that the density patch C2 re-formed a plurality of times by repeatedly performing the process in S32-S41 of FIG. 9 has exceeded the starting point of the conveying belt 68. Hence, there is a high probability that the formation position of the next density patch C2 will overlap the Y coordinate Y5 of the position at which the density patch C2 was initially printed on the conveying belt 68. By reaching a YES determination in S41 of FIG. 9, the CPU 22 does not return to S32 but advances to S42 in order to confirm the position for re-forming the next density patch C2. As will be described in greater detail later, the CPU 22 re-forms the density patch C2 one more time by executing the process in S32 of FIG. 9 in the example of FIG. 11(*b*).

There is a high likelihood that the measured density data of the density patch C2 will not fall within the range of values in the normal value table (S38: NO) if the formation position of the re-formed density patch C2 overlaps the Y coordinate Y5 of the position at which the density patch C2 was initially printed on the conveying belt 68. Accordingly, in S41 and S42 of FIG. 9 the CPU 22 determines the position for re-forming the next density patch C2 so that the formation position does not overlap the Y coordinate Y5 of the original density patch C2. As described earlier, the Y coordinate Y1 in the formation position of the cyan 1 density patch is set to a value at least two times the patch height b from the starting point of the conveying belt 68 (the point at which the value of the conveying distance counter 24*d* is 0). This functions to ensure that at least one of the density patches C1-K5 can be formed between the starting point and the formation position for the corresponding density patches C1-K5 initially formed on the conveying belt 68 after the conveying belt 68 has moved one complete circuit and returned to the starting point, and to ensure that the density patch being re-formed does not overlap the formation position of the initially formed density patch. By setting the Y coordinate Y1 in this way, it is possible to perform the processes in S41 and S42 without overlapping the initial formation positions of the density patches C1-K5.

When the CPU 22 reaches a YES determination in S41 of FIG. 9, in S42 the CPU 22 determines whether the Y coordinate of a formation position found by adding two times the patch height b to the Y coordinate of the formation position stored in the error density patch formation data memory area 24*b* for the density patch in question is greater than or equal to the Y coordinate in the formation position stored in the density patch formation data memory area 23*b* for the density patch in question. The process of S42 will be described in greater detail with reference to FIGS. 11(*b*) and 12(*a*).

FIG. 11(*b*) shows the example in which the CPU 22 reaches a NO determination in S42 of FIG. 9, and FIG. 12(*a*) shows an example in which the CPU 22 reaches a YES determination in S42 of FIG. 9. The examples of FIGS. 11(*b*) and 12(*a*) are for the density patch C2. Further, the examples in FIGS. 11(*b*) and 12(*a*) assume that the density patch C2 has been re-formed a plurality of times through the process of S32-S34 in FIG. 9.

First, an example in which the CPU 22 reaches a NO determination in S42 of FIG. 9 will be described with reference to FIG. 11(*b*). The Y coordinate for the formation position is found by adding two times the patch height b to the Y coordinate Yα of the formation position for the density patch C2 stored in the error density patch formation data memory area 24*b* (the density patch C2 with hatch marks in FIG. 11(*b*); Yα+2b). Since this Y coordinate is smaller than the Y coordinate Y5 of the formation position for the density patch C2 stored in the density patch formation data memory area 23*b* (the position at which the density patch C2 was initially printed on the conveying belt 68), the CPU 22 reaches a NO determination in S42 of FIG. 9. In other words, the CPU 22 determines that the formation position of the density patch C2 to be re-formed next in S32-S34 of FIG. 9 does not overlap the Y coordinate Y5. Therefore, the CPU 22 reaches a NO determination in S42 and returns to S32 in order to re-form the density patch C2.

Next, the example in which the CPU 22 reaches a YES determination in S42 of FIG. 9 will be described with reference to FIG. 12(*a*). In this example, the Y coordinate of the formation position is found by adding two times the patch height b to the Y coordinate Yβ of the formation position for the density patch C2 stored in the error density patch formation data memory area 24*b* (the density patch C2 with hatch marks in FIG. 12(*a*); Yβ+2b). Since this Y coordinate is greater than the Y coordinate Y5 of the formation position for the density patch C2 stored in the density patch formation data memory area 23*b* (the position at which the density patch C2 was initially printed on the conveying belt 68), the CPU 22 reaches a YES determination in S42 of FIG. 9. In other words, the CPU 22 determines that the formation position of the density patch C2 to be re-formed next in S32-S34 of FIG. 9 overlaps the Y coordinate Y5. Therefore, the CPU 22 reaches a YES determination in S42 and rather than returning to S32 advances to S43 to modify the formation position of the next density patch C2 so as not to overlap the original formation position.

In S43 of FIG. 9 the CPU 22 adds the patch width a to the X coordinate of the density patch stored in error density patch formation data memory area 24*b* (the density patch corresponding to the calibration flag 24*a* acquired in S30) and stores the result in error density patch formation data memory area 24*b*. This process shifts the position for re-forming the density patch in the X direction so that the formation position does not overlap the position at which the density patch was initially formed on the conveying belt 68.

In S44 the CPU 22 reads density patch formation data for the density patch currently being processed from the error density patch formation data memory area 24*b* and in S45 determines whether the X coordinate of the formation position in the density patch formation data exceeds Xmax. As described above, Xmax is a value obtained by subtracting the patch width a from an end 68*e*1 of the printable range in the X direction. The end 68*e*1 of the printable range is a downstream end 68*e*2 of the printable range in the X direction, which is opposite end 68*e*2 (upstream end) nearest the density sensor 80 in FIG. 4. Xmax therefore indicates the maximum X coordinate that can be used for forming the density patches C1-K5.

Hence, when the CPU 22 determines that the X coordinate of the formation position in the density patch formation data for the density patch read in S44 exceeds Xmax (S45: YES), then the CPU 22 can not re-form the density patch read in S44 on the conveying belt 68 and ends the calibration retry process.

On the other hand, if the CPU 22 determines that the X coordinate does not exceed Xmax (S45: NO), indicating that the formation position for the density patch to be re-formed falls within the printable range in the X direction, the CPU 22 advances to S46 in order to form the density patch.

In S46 the CPU 22 reads the Y coordinate of the formation position for the density patch in question from the density patch formation data memory area 23*b*, updates the Y coordinate of the formation position for the density patch in question stored in the error density patch formation data memory area 24*b* to the Y coordinate read from the density patch formation data memory area 23*b*, stores the updated Y-coordinate data in the error density patch formation data memory area 24*b*, and returns to S34. Through this process, the Y coordinate of the formation position for the density patch being re-formed is set to the Y coordinate used when initially forming the same density patch on the conveying belt 68 in S13 of the calibration process in FIG. 8 (see FIG. 4).

The process of S43-S46 will be described with reference to FIGS. 12(*a*) and 12(*b*). In these examples, the density patch in question is the density patch C2 (cyan 2). Further, the examples in FIGS. 12(*a*) and 12(*b*) assume that the density patch C2 has been re-formed a plurality of times in S32-S34 of FIG. 9.

In the example of FIG. 12(*a*), the X coordinate of the formation position in the density patch formation data for the density patch C2 obtained by adding the patch width a to the X coordinate Xβ of the formation position for the density patch C2 stored in the error density patch formation data memory area 24*b* (Xβ+a) does not exceed Xmax. Accordingly, the X coordinate for the position at which the density patch C2 is to be re-formed is set to Xβ+a. Further, the Y coordinate for the position at which the density patch C2 is to be re-formed is set to the Y coordinate Y5 of the position at which the density patch C2 was initially formed in S13 of FIG. 8. The density patch C2 having hatch marks in FIG. 12(*a*) is formed based on the density patch formation data updated in this way.

However, in the example of FIG. 12(*b*), the X coordinate of the formation position in the density patch formation data for the density patch C2 obtained by adding the patch width a to the X coordinate Xγ for the formation position of the density patch C2 in question (the density patch C2 having hatch marks in FIG. 12(*b*)) stored in the error density patch formation data memory area 24*b* (Xγ+a) exceeds Xmax. Hence, the formation position for the next density patch C2 to be re-formed goes beyond the printable region in the X direction. Hence, the density patch C2 cannot be re-formed, and the CPU 22 ends the calibration retry process of FIG. 9.

Accordingly, when the CPU 22 reaches a NO determination in S45 of FIG. 9, the formation position for the density patch to be re-formed next is shifted by the patch width a in S43. Since the conveying belt 68 is configured to move circularly, the density patches C1-K5 can overlap positions in which the density patches C1-K5 were formed before as the conveying belt 68 circulates and the density patches C1-K5 are repeatedly formed. Accordingly, there is a high probability the CPU 22 will determine in S38 that the measured density falls outside the range of values in the normal value table when the density patches C1-K5 are repeatedly formed. However, by shifting the formation position of density patches C1-K5 by the patch width a in S43, it is possible to re-form the density patches C1-K5 at positions shifted in the X direction. As a result, the density sensor 80 can measure the densities of the density patches C1-K5 formed at these shifted positions, increasing the probability that the CPU 22 will determine the measured densities fall within the range of values in the normal value table in S38.

On the other hand, the CPU 22 ends the calibration retry process of FIG. 9 when reaching a YES determination in S45. Hence, if the surface of the conveying belt 68 contains tears or deflection, the CPU 22 will not continue forming the density patches C1-K5 in the calibration retry process, despite the density sensor 80 not being able to properly measure the densities of the density patches C1-K5, thereby preventing the unnecessary consumption of toner.

Returning to FIG. 8 after ending the calibration retry process in S23, in S24 the CPU 22 determines whether all calibration flags 24*a* are off. If the CPU 22 determines that all calibration flags 24*a* are off (S24: YES), then all measured density data for the density patches C1-K5 fall within the range of values in the normal value table stored in the normal value table memory area 23*c*. Therefore, in S25 the CPU 22 reads the measured density data from the measured density memory area 24*c*, reads the target density data from the target data memory area 23*d*, creates calibration tables (see FIG. 6) from the measured density data and target density data, and stores the calibration tables in the calibration table memory area 25*a*. Subsequently, the CPU 22 ends the calibration process.

In S25 the CPU 22 creates a calibration table for each of the colors and stores the calibration tables in the calibration table memory area 25*a*. When creating the cyan calibration table, for example, the CPU 22 reads the cyan measured density data from the cyan measured density memory area 24*c*1, reads the cyan target density data from the cyan target data memory area 23*d*1, creates the cyan calibration table, and stores the cyan calibration table in the cyan calibration memory area 25*a*1. In this way, the cyan calibration table shown in FIG. 6(*c*) can be created.

Here, the process in S25 will be described in greater detail with reference to FIGS. 6(*a*) through 6(*c*). FIG. 6(*a*) is a table showing relation between the target density data stored in the cyan target data memory area 23$d$1 and the cyan measured density data stored in the cyan measured density memory area 24$c$1. FIG. 6($b$) is a graph plotting interpolated data of the target data, and interpolated data of the measured density data. FIG. 6($c$) is a table showing the cyan calibration table created and stored in the standard mode cyan calibration table memory area 24$d$1 through the process of S25.

The CPU 22 first performs linear interpolation on the measured density data stored in the cyan measured data memory area 24$c$1 and the target density data stored in the cyan target data memory area 23$d$1.

In the graph of FIG. 6($b$), the horizontal axis represents the interpolated set density (%), and the vertical axis represents the interpolated measured density. Hence, the horizontal axis indicates the interpolated values of the set densities, while the vertical axis indicates the interpolated measured cyan densities and the interpolated target densities shown in FIG. 6($a$).

As shown in FIG. 6($b$), when the set density is 20%, the target density (target value for measured density) is 0.20, while the density of the cyan interpolation data is 0.15. Hence, it is known that even when a cyan image is printed on the recording paper 3 based on a 20% set density, the measured density of the printed cyan image outputted by the density sensor 80 will be 0.15, which is lower than the density of 0.20 in the cyan target data. In this case, the CPU 22 reads the set density that is required for achieving a measured density for the printed cyan image equivalent to the 0.20 target density from FIG. 6($b$). As can be seen from FIG. 6($b$), the set density must be corrected from 20% to 30% in order to achieve a measured density of 0.20 for the printed cyan image.

As another example, when the set density is 80%, the target value is 0.80, while the density in the interpolation data is 0.62.

In this case, the CPU 22 reads the set density from FIG. 6($b$), which is required for achieving a measured density for the printed cyan image equivalent to the target density of 0.80. As can be seen in FIG. 6($b$), the set density must be calibrated from 80% to 90% in order to obtain a 0.80 measured density for the printed cyan image.

In this way, the CPU 22 creates a cyan calibration table from the cyan target density data and the cyan measured density data. If the measured density of an image printed in cyan is less than the cyan target density in the target density data, or if the measured density of the printed cyan image is greater than the cyan target density, the cyan calibration table can appropriately calibrate the set density so that the measured density of the printed cyan image is equal to the cyan target density in the target density data.

By creating each of the calibration tables in S25, the CPU 22 can appropriately calibrate the set densities using the calibration tables so that the measured densities of the density patches C1-K5 match the target densities in the target density data, even when the measured densities of the density patches C1-K5 formed on the conveying belt 68 are less than or greater than the target densities in the target density data stored in the reference density memory area 23$d$.

On the other hand, if the CPU 22 determines in S24 that not all calibration flags 24$a$ are off (S24: NO), indicating that the calibration retry process of FIG. 9 was canceled because the density patches C1-K5 could not be re-formed on the conveying belt 68, in S26 the CPU 22 displays a message on the display unit 109 indicating that the results of the calibration retry process were abnormal, and subsequently ends the calibration process without creating calibration tables.

According to the calibration process of FIG. 8 and the calibration retry process of FIG. 9 described above, the density patches C1-K5 are formed on the conveying belt 68 when performing calibration, after which the density sensor 80 measures the density of each of the density patches C1-K5. The densities measured by the density sensor 80 are compared to values in a normal value table stored in the normal value table memory area 23$c$ to determine whether the measured densities fall within the range of normal values. If the measured density for any of the density patches is found to fall outside the range of values in the normal value table, then the density patch determined to have a value outside the normal values is repeatedly re-formed on the conveying belt 68 until the measured density of the density patch falls within the range of values in the normal value table. When the measured densities for all density patches repeatedly formed on the conveying belt 68 are found to fall within the range of normal values, all calibration flags 24$a$ are set to OFF, at which time the CPU 22 reads the measured density data from the measured density memory area 24$c$, reads the target density data from the target data memory area 23$d$, creates calibration tables from the measured density data and target density data, and calibrates the image densities using these calibration tables. Hence, if the density of one of the density patches C1-K5 is found to fall outside the range of normal values in the normal value table when calibrating image density, the CPU 22 can re-form the density patch having the abnormal measured density on the conveying belt 68 in the calibration retry process of FIG. 9, without re-forming all the density patches C1-K5. This method reduces the number of density patches re-formed in the calibration process, thereby reducing the amount of toner consumed when repeating calibration.

Further, in the calibration retry process of FIG. 9, the density patch whose measured value is found to be outside the range of normal values is formed repeatedly on the conveying belt 68 until the measured density for this density patch falls within the normal values in the normal value table, thereby increasing the probability that the density of the re-formed density patch can be measured properly and increasing the reliability of the calibration process.

While the invention has been described in detail with reference to specific embodiment thereof, it would be apparent to those skilled in the art that many modifications and variations may be made therein without departing from the spirit of the invention, the scope of which is defined by the attached claims.

In the embodiment, the present invention is applied to a tandem color laser printer 1. However, the present invention may also be applied to a transfer drum-type color laser printer, a transfer belt-type color laser printer, or a direct transfer-type color laser printer.

Further, while the density sensor 80 measures the densities of density patches C1-K5 formed on the conveying belt 68 in the embodiment, an image scanner provided in the laser printer 1 may be used to scan and measure the densities of the density patches C1-K5 formed on the paper 3 in order to perform calibration. Since the scanner performs the function of the density sensor 80 for measuring the densities of the density patches C1-K5, the density sensor 80 is not necessary in this example.

Further, while density patch formation data for the density patches C1-K5 is stored in the density patch formation data memory area 23$b$ in the embodiment, density patch formation data for the density patches C1-K5 may be stored on the PC 125 connected to the laser printer 1. When executing the calibration process in this case, the PC 125 outputs the density patch formation data for the density patches C1-K5 to the laser printer 1, and the laser printer 1 stores the density patch formation data in the RAM 24. The CPU 22 subsequently executes the calibration process by reading the density patch formation data from the RAM 24. This method can reduce the capacity required for the ROM 23.

Further, while the laser printer 1 forms square density patches C1-K5 on the conveying belt 68 in the embodiment, but the density patches may be formed in a polygonal shape or other shape.

Further, in the embodiment, the laser printer 1 repeatedly forms the error density patch while successively shifting the position of the density patch in the Y direction until the conveying belt 68 moves one complete circuit, and then shifting the position of the density patch in the X direction. However, the laser printer 1 may repeatedly form the error density patch while successively shifting the position of the density patch in the X direction until the density patch is formed at a location near to the end of printable range of the conveying belt in the X direction and then shifting the position in the Y direction. In this case, the calibration process shown in FIG. 9 is modified by exchanging the process of adding b to Y coordinate in S33 with the process of adding a to X coordinate in S43, and exchanging the process of Y coordinate determination in S41 and S42, with the process of X coordinate determination in S45.

In the embodiment, when reforming the test image, the position of the test image is shifted the length b in the Y direction or the length a in the X direction. However, the position of the test image may be shifted a distance grater than the length b in the Y direction or a distance grater than the length a in the X direction.

Although the present invention has been described with respect to specific embodiments, it will be appreciated by one skilled in the art that a variety of changes may be made without departing from the scope of the invention.

What is claimed is:

1. An image-forming device, comprising:

an image-forming unit forming an image on a recording medium based on inputted image data;

a test image memory storing a plurality of sets of test image data, each set of test image data corresponding to one of a plurality of test images, each set of test image being used for calibrating density of image to be formed by the image-forming unit;

a test image forming unit controlling the image-forming unit to form the plurality of test images based on the plurality of sets of test image data a density measuring unit measuring the density of each test image that the image-forming unit has formed on the recording medium;

an abnormality determining unit comparing the density of each test image measured by the density measuring unit with prescribed values that are pre-stored in association with the corresponding set of test image data to determine whether the measured density of the test image is abnormal, a set of test image data that corresponds to a test image whose measured density is determined to be abnormal being a set of to-be-reformed test image data; and a test image re-forming unit that, if there is at least one set of to-be-reformed test image data in the plurality of sets of test image data, controls the image-forming unit to re-form a test image based on the at least one set of to-be-reformed test image data, the test image re-forming unit controlling the image forming unit not to re-form a test image based on those test image data that is other than the at least one set of to-be-reformed test image data, the test image reforming unit controlling the measuring unit to measure the density of the reformed test image.

2. The image forming device according to claim 1, further comprising:

a target density memory storing a target density of a test image corresponding to each set of test image data stored in the test image memory as a target for density calibration;

a measured density outputting unit outputting to a density comparing unit, the measured density of a test image that is determined not to be abnormal by the abnormality determining unit, the density comparing unit comparing the measured density received from the measured density outputting unit with the corresponding target density; and a calibration data creating unit creating calibration data for calibrating density of image to be formed by the image-forming unit on the recording medium based on density comparison result obtained by the density comparing unit.

3. The image forming device according to claim 1, wherein the test image re-forming unit comprises:

an abnormal data memory storing abnormal data indicative of one set of to-be-reformed test image data among the at least one set to to-be-reformed test image data;

an abnormal data deleting unit deleting the abnormal data from the abnormal data memory when the abnormality determining unit determines that a measured density of a test image re-formed by the image-forming unit based on the one set of to-be-reformed test image data is not abnormal; and a continuous test image forming unit repeatedly controlling the image forming unit to form a test image based on the one set of the to-be-reformed test image data while the abnormal data is maintained in the abnormal data memory.

4. The image-forming device according to claim 3, wherein, if the abnormality determining unit determines that images for more than one set of test image data are abnormal, the abnormal data memory stores more than one record of abnormal data indicative of the more than one set of to-be-reformed test image.

5. The image-forming device according to claim 4, wherein the test image re-forming unit comprises:

a single data record reading unit reading one record of abnormal data from the abnormal data memory; and a single test image forming unit controlling the image forming unit to form one test image based on the one set of to-be-reformed test image data indicated by the single record of abnormal data read by the single data record reading unit.

6. The image-forming device according to claim 1, wherein the test image re-forming unit comprises a position controlling unit modifying position data indicative of an original position, at which the image-forming unit has formed a test image based on one set of to-be-reformed test image data among the at least one set of to-be-reformed test image data, and outputting the modified position data to the image-forming unit, the modified position data being indicative of a different position on the recording medium than the original position of the test image, the image-forming unit re-forming the test image at the different position based on the modified position data and the one set of to-be-reformed test image data.

7. The image-forming device according to claim 3, wherein the continuous test image forming unit comprises a first direction controlling unit controlling the image-forming unit to successively shift a position of the test image in a first direction by at least the length of the test image defined in the first direction while the image-forming unit repeatedly forms the test image based on the one set of to-be-reformed test image data.

8. The image-forming device according to claim 7, wherein the recording medium is configured to move circularly in the first direction; and the first direction controlling unit comprises a second direction controlling unit controlling the image forming unit to shift the position of the test image in a second direction orthogonal to the first direction by at least the length of the test image defined in the second direction, after the image-forming unit has formed the test image repeatedly and a gap, defined in the first direction between the position of the test image that has been formed for the first time, and the position of the test image that has been formed at the latest, becomes an amount smaller than the length of the test image in the first direction.

9. The image-forming device according to claim 8, wherein the continuous test image forming unit comprises a halting unit halting formation of the test image by the image-forming unit after the image-forming unit has formed the test image repeatedly and a gap, defined in the first direction between the position of the test image that has been formed for the first time after the second direction controlling unit has shifted the position of the test image in the second direction at the latest, and the position of the test image that has been formed at the latest, becomes an amount smaller than the length of the test image in the first direction, and another gap defined in the second direction between the position of the test image that has been formed at the latest and a downstream end of an image-forming range of the recording medium in the second direction, becomes an amount smaller than the length of the test image in the second direction.

10. The image-forming device according to claim 1, wherein the abnormality determining unit pre-stores the prescribed values indicative of a suitable density range for each of the plurality of test images and determines whether the density of each test image measured by the density measuring unit falls within the corresponding suitable density range.

11. A method for measuring density of a test image, comprising:

forming a plurality of test images based on a plurality of sets of test image data;

measuring a density of each test image;

determining whether the measured density of each test image is abnormal by comparing the measured density of the test image with prescribed values pre-stored in association with the corresponding set of test image data, a set of test image data that corresponds to a test image whose measured density is determined to be abnormal being a set of to-be-reformed test image data;

re-forming, if there exists at least one set of to-be-reformed test image data in the plurality of sets of test image data, a test image based on the at least one set of to-be-reformed test image data, the re-forming failing to re-form a test image based on those test image data that is other than the at least one set of to-be-reformed test image data; and re-measuring a density of the test image re-formed.

12. The method according to claim 11, further comprising:

comparing a density of a test image that is determined not to be abnormal with a target density for the test image; and creating calibration data for calibrating density of image to be formed based on density comparison result.

* * * * *